US009179739B2

(12) United States Patent
Bell et al.

(10) Patent No.: US 9,179,739 B2
(45) Date of Patent: Nov. 10, 2015

(54) FOOTWEAR INCORPORATING LOOPED TENSILE STRAND ELEMENTS

(75) Inventors: Thomas G. Bell, Portland, OR (US); Bryan N. Farris, North Plains, OR (US); Kevin W. Hoffer, Portland, OR (US); James C Meschter, Portland, OR (US); Robert C. Williams, Jr., Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 627 days.

(21) Appl. No.: 13/529,381

(22) Filed: Jun. 21, 2012

(65) Prior Publication Data

US 2013/0340283 A1 Dec. 26, 2013

(51) Int. Cl.

| | |
|---|---|
| ***A43C 11/00*** | (2006.01) |
| ***A43C 1/04*** | (2006.01) |
| ***A43B 23/02*** | (2006.01) |
| ***A43C 1/00*** | (2006.01) |

(52) U.S. Cl.

CPC ..... *A43C 11/002* (2013.01); *A43B 23/0235* (2013.01); *A43B 23/0275* (2013.01); *A43C 1/00* (2013.01); *A43C 1/04* (2013.01)

(58) Field of Classification Search

CPC ..... A43C 1/00; A43C 1/003; A43C 1/06; A43C 1/04; A43C 11/00; A43C 11/004; A43C 11/002

USPC ..... 36/50.1

See application file for complete search history.

(56) References Cited

U.S. PATENT DOCUMENTS

| | | | | |
|---|---|---|---|---|
| 2,034,091 | A | 3/1936 | Dunbar | |
| 2,048,294 | A | 7/1936 | Roberts | |
| 2,205,356 | A | 6/1940 | Gruensfelder | |
| 2,311,996 | A | 2/1943 | Parker | |
| 3,439,434 | A | 4/1969 | Tangorra | |
| 3,672,078 | A | 6/1972 | Fukuoka | |
| 3,823,493 | A | 7/1974 | Brehm et al. | |
| 4,627,369 | A | 12/1986 | Conrad et al. | |
| 4,634,616 | A | 1/1987 | Musante | |
| 4,642,819 | A | 2/1987 | Ales et al. | |
| 4,756,098 | A | 7/1988 | Boggia | |
| 4,858,339 | A | 8/1989 | Hayafuchi et al. | |
| 4,873,725 | A | 10/1989 | Mitchell | |
| 5,149,388 | A | 9/1992 | Stahl | |
| 5,156,022 | A | 10/1992 | Altman | |
| 5,271,130 | A | 12/1993 | Batra | |
| 5,285,658 | A | 2/1994 | Altman et al. | |
| 5,345,638 | A | 9/1994 | Nishida | |
| 5,359,790 | A | 11/1994 | Iverson et al. | |
| 5,367,795 | A | 11/1994 | Iverson et al. | |
| 5,371,957 | A * | 12/1994 | Gaudio | 36/50.1 |

(Continued)

FOREIGN PATENT DOCUMENTS

| | | |
|---|---|---|
| CN | 101125044 A | 2/2008 |
| DE | 20215559 | 1/2003 |

(Continued)

*Primary Examiner* — Ted Kavanaugh

(74) *Attorney, Agent, or Firm* — Plumsea Law Group, LLC

(57) ABSTRACT

A tensile strand element for an article of footwear is disclosed. The tensile strand element includes one or more tensile strands secured at their endpoints between the sole and upper of an article of footwear, creating one or more looped portions. The unsecured looped portions may extend into the fastening region of the footwear and engage with a fastening system to tighten the footwear upper snugly against a wearer's foot to provide added support.

24 Claims, 21 Drawing Sheets

(56) References Cited

U.S. PATENT DOCUMENTS

| | | | | |
|---|---|---|---|---|
| 5,380,480 | A | 1/1995 | Okine et al. | |
| 5,399,410 | A | 3/1995 | Urase | |
| 5,645,935 | A | 7/1997 | Kemper et al. | |
| 5,832,540 | A | 11/1998 | Knight | |
| D405,587 | S | 2/1999 | Merikoski | |
| 5,930,918 | A | 8/1999 | Healy | |
| 5,990,378 | A | 11/1999 | Ellis | |
| 6,003,247 | A | 12/1999 | Steffe | |
| 6,004,891 | A | 12/1999 | Tuppin et al. | |
| 6,009,637 | A | 1/2000 | Pavone | |
| 6,029,376 | A | 2/2000 | Cass | |
| 6,038,702 | A | 3/2000 | Knerr | |
| 6,128,835 | A | 10/2000 | Ritter | |
| 6,151,804 | A | 11/2000 | Hieblinger | |
| 6,164,228 | A | 12/2000 | Lin | |
| 6,170,175 | B1 | 1/2001 | Funk | |
| 6,213,634 | B1 | 4/2001 | Harrington et al. | |
| 6,615,427 | B1 | 9/2003 | Hailey | |
| 6,665,958 | B2 | 12/2003 | Goodwin | |
| 6,718,895 | B1 | 4/2004 | Fortuna | |
| 6,860,214 | B1 | 3/2005 | Wang | |
| 6,910,288 | B2 | 6/2005 | Dua | |
| 6,952,891 | B2 * | 10/2005 | Hirayama | 36/50.5 |
| 7,086,179 | B2 | 8/2006 | Dojan | |
| 7,086,180 | B2 | 8/2006 | Dojan | |
| 7,100,310 | B2 | 9/2006 | Foxen | |
| 7,293,371 | B2 | 11/2007 | Aveni | |
| 7,337,560 | B2 | 3/2008 | Marvin et al. | |
| 7,574,818 | B2 | 8/2009 | Meschter | |
| 7,665,230 | B2 | 2/2010 | Dojan | |
| 7,676,956 | B2 | 3/2010 | Dojan | |
| 7,849,518 | B2 | 12/2010 | Moore et al. | |
| 7,870,681 | B2 | 1/2011 | Meschter | |
| 7,870,682 | B2 | 1/2011 | Meschter et al. | |
| 8,132,340 | B2 | 3/2012 | Meschter | |
| 8,215,033 | B2 * | 7/2012 | Carboy et al. | 36/50.1 |
| 8,800,172 | B2 * | 8/2014 | Dua et al. | 36/50.1 |
| 8,844,167 | B2 * | 9/2014 | Greene | 36/45 |
| 2001/0051484 | A1 | 12/2001 | Ishida et al. | |
| 2003/0178738 | A1 | 9/2003 | Staub et al. | |
| 2004/0074589 | A1 | 4/2004 | Gessler et al. | |
| 2004/0118018 | A1 | 6/2004 | Dua | |
| 2004/0142631 | A1 | 7/2004 | Luk | |
| 2004/0181972 | A1 | 9/2004 | Csorba | |
| 2004/0261295 | A1 | 12/2004 | Meschter | |
| 2005/0028403 | A1 | 2/2005 | Swigart | |
| 2005/0115284 | A1 | 6/2005 | Dua | |
| 2005/0132609 | A1 | 6/2005 | Dojan | |
| 2005/0268497 | A1 | 12/2005 | Alfaro | |
| 2006/0048413 | A1 | 3/2006 | Sokolowski | |
| 2006/0137221 | A1 | 6/2006 | Dojan | |
| 2007/0199210 | A1 | 8/2007 | Vattes et al. | |
| 2007/0271821 | A1 | 11/2007 | Meschter | |
| 2008/0110049 | A1 | 5/2008 | Sokolowski et al. | |
| 2010/0018075 | A1 | 1/2010 | Meschter et al. | |
| 2010/0037483 | A1 | 2/2010 | Meschter et al. | |
| 2010/0043253 | A1 | 2/2010 | Dojan | |
| 2010/0154256 | A1 * | 6/2010 | Dua | 36/25 R |
| 2010/0175276 | A1 | 7/2010 | Dojan et al. | |
| 2010/0251491 | A1 | 10/2010 | Dojan et al. | |
| 2011/0041359 | A1 | 2/2011 | Dojan et al. | |
| 2012/0198727 | A1 | 8/2012 | Long | |

FOREIGN PATENT DOCUMENTS

| | | | |
|---|---|---|---|
| EP | 008284 | | 6/1983 |
| EP | 0818289 | A2 | 1/1998 |
| FR | 1462349 | | 2/1967 |
| FR | 2046671 | | 3/1971 |
| FR | 2457651 | | 12/1980 |
| WO | 9843506 | | 10/1998 |
| WO | 03013301 | | 2/2003 |
| WO | WO2004089609 | | 10/2004 |
| WO | WO2007139567 | | 12/2007 |
| WO | WO2007140055 | | 12/2007 |

* cited by examiner

FOOTWEAR INCORPORATING LOOPED TENSILE STRAND ELEMENTS

BACKGROUND

The present disclosure relates generally to an article of footwear incorporating looped tensile strand elements.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a fastening system to adjust the fit of the footwear, as well as to permit entry and removal of the foot from the void within the upper. In addition, the upper may include a tongue that extends under the fastening system to enhance adjustability and comfort of the footwear, and the upper may incorporate a heel counter.

The sole structure is typically secured to a lower portion of the upper creating a lasting margin between the sole and the upper. The sole structure is primarily positioned between the foot and the ground, and may be formed from one or more layers. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximate a lower surface of the foot to enhance footwear comfort.

SUMMARY

In one aspect, the present disclosure provides an article of footwear having an upper with a fastening region that includes a fastening system, a sole that is attached to the upper and spaced from the fastening region, and a tensile strand element. The tensile strand element includes a first attachment point and a second attachment point adjacent to the sole. According to aspects set forth herein, the tensile strand element further includes an unsecured portion located between the first attachment point and the second attachment point. The unsecured portion of the tensile strand element also includes a looped portion to receive an element of the fastening system, where an axis extending through the looped portion is substantially parallel to an exterior surface of the upper.

In another aspect the present disclosure provides an article of footwear having an upper with a fastening region that includes a fastening system and a cover layer over the upper that forms a portion of an exterior surface of the footwear. The upper and the cover layer form an unattached region where the upper and the cover layer are unsecured to each other. The cover layer further defines an aperture in the unattached region. The footwear also includes a sole attached to the upper and spaced from the fastening region, as well as a tensile strand element having a first attachment point and a second attachment point adjacent to the sole. The tensile strand element further includes an unsecured portion located between the first attachment point and the second attachment point. According to aspects set forth herein, a first section of the unsecured portion is located between the upper and the cover layer in the unattached region and a second section of the unsecured portion includes a looped portion that extends through the aperture in the cover layer and is located adjacent to the exterior surface of the footwear. Further, the looped portion receives an element of the fastening system.

In yet another aspect, the present disclosure provides an article of footwear having an upper with a fastening region that includes a lace, a sole attached to the upper and spaced from the fastening region, and a tensile strand element. According to aspects set forth herein, the tensile strand element includes two tensile strands. The first tensile strand has a first attachment point, a second attachment point, and a first unsecured portion located between the first attachment point and the second attachment point. The first unsecured portion further includes a first looped portion. The second tensile strand has a third attachment point, a fourth attachment point, and a second unsecured portion located between the third attachment point and the fourth attachment point. The second unsecured portion further includes a second looped portion. Further, the first looped portion and the second looped portion are co-located and are both configured to receive an element of the lace.

In yet another aspect the present disclosure provides a method of manufacturing an article of footwear. The method generally includes providing a base layer and stitching a tensile strand to the base layer. According to the method, the base layer has a first region and a second region that are spaced from each other by at least five centimeters. In particular, the method includes first stitching a tensile strand to the first region of the base layer and the second region of the base layer to form a first unattached portion of the tensile strand that is located between the first region and the second region. The method then includes stitching the tensile strand to the second region of the base layer and the first region of the base layer to form a second unattached portion of the tensile strand that is located between the second region and the first region. The method also provides locating the first region adjacent to the second region to form loops from the first unattached portion and the second unattached portion. Further, the method includes incorporating the tensile strand and the loops into the article of footwear.

In yet another aspect the present disclosure provides another method of manufacturing an article of footwear. The method generally includes providing a base layer and securing multiple tensile strand segments to the base layer. According to the method, the base layer has a first region and a second region that are spaced from each other by at least five centimeters. In particular, the method includes first securing multiple tensile strand segments to the first region and the second region to form a plurality of unattached portions of the tensile strand segments that are located between the first region and the second region. The method then includes joining the first region and the second region adjacent to a sole of the footwear to form loops from the unattached portions of the tensile strand segments. Further, the method includes locating the loops within a fastening region of the footwear, where the fastening region is spaced from the sole.

In yet another aspect the present disclosure provides a method of manufacturing an article of footwear. The method first includes securing multiple tensile strand segments in a first region and a second region to form a plurality of unattached portions of the tensile strand segments that are positioned between the first region and the second region. The method then includes attaching areas of the tensile strand segments positioned at the first region and the second region adjacent to a sole of the article of footwear to form loops from the unattached portions of the tensile strand segments. The method further includes locating the loops within a fastening region of the footwear, where the fastening region is spaced from the sole.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose an article of footwear that includes tensile strand loops. The article of footwear is disclosed as having a general configuration suitable for walking or running. Concepts associated with the footwear, including the upper, may be applied to a variety of athletic footwear types, including but not limited to baseball shoes, basketball shoes, cross-training shoes, cycling shoes, football shoes, tennis shoes, soccer shoes, and hiking boots, for example. The concepts may also be applied to footwear types that are generally considered to be non-athletic, including but not limited to dress shoes, loafers, sandals, and work boots. An individual skilled in the art will appreciate that the concepts disclosed herein apply for use with a wide variety of footwear styles in addition to the specific style discussed in the following material and depicted in the accompanying figures.

General Footwear Structure

Figure 1:
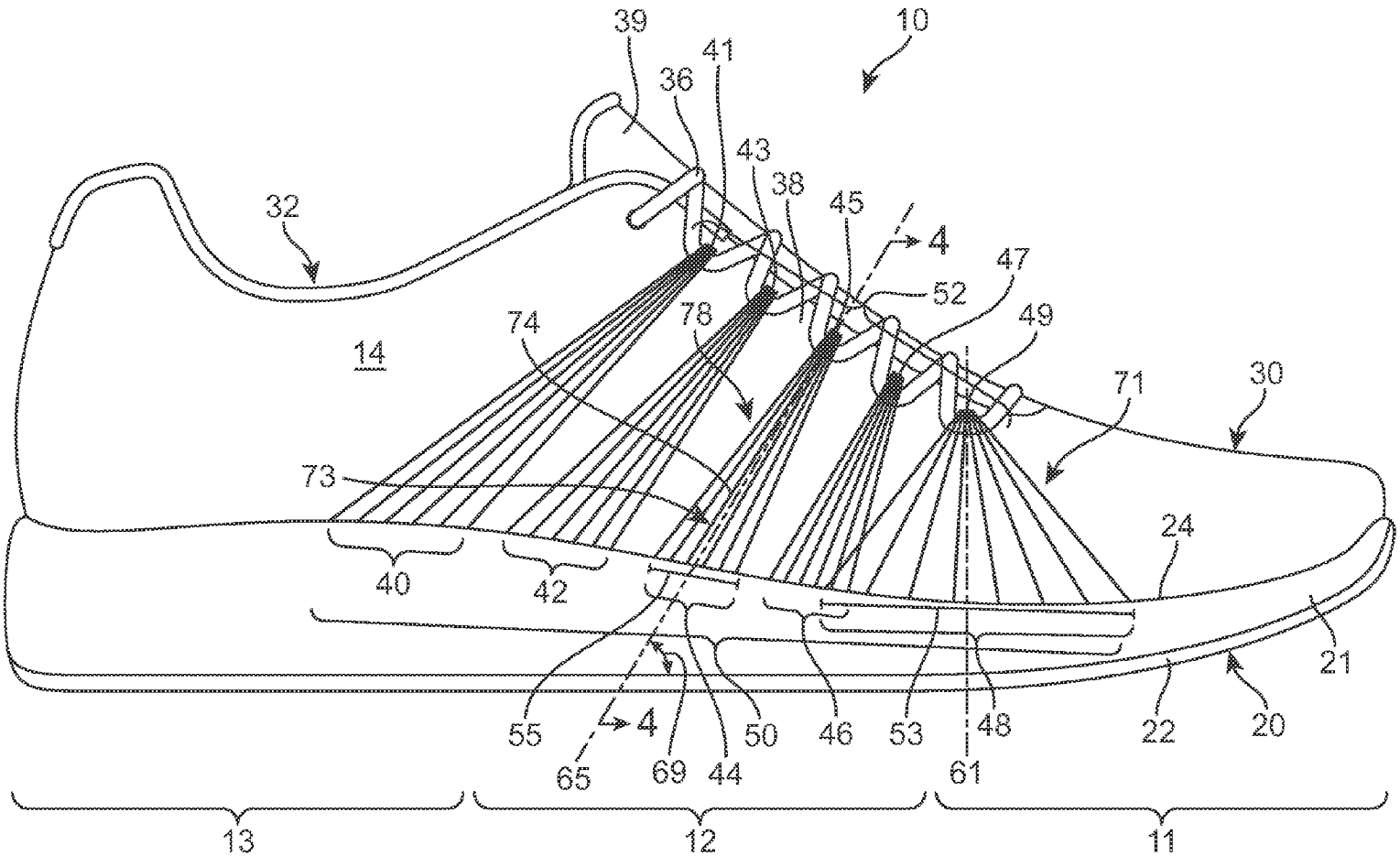
FIG. 1 is a lateral side elevational view of an article of footwear.
Figure 2:
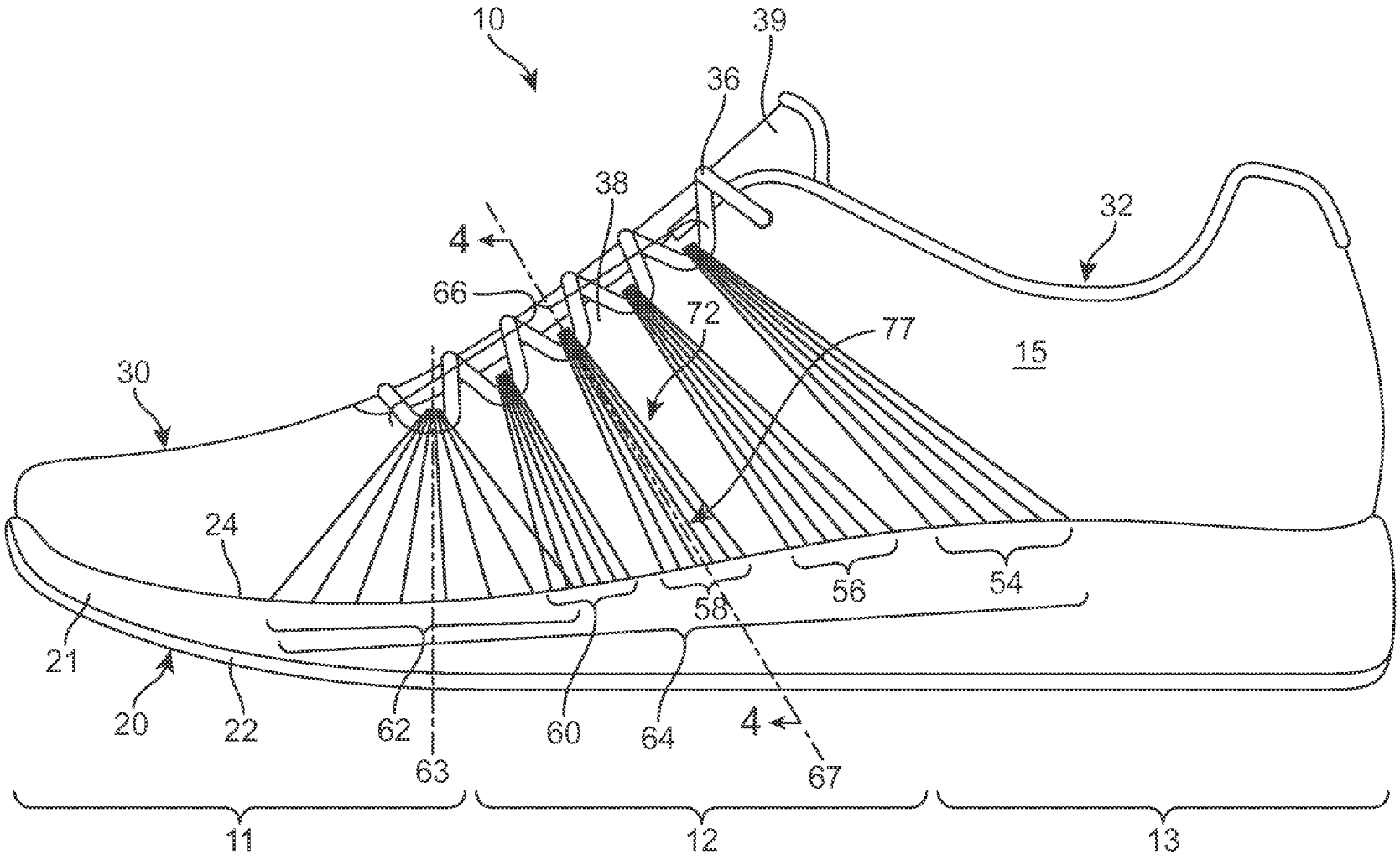
FIG. 2 is a medial side elevational view of the article of footwear.
Figure 3:
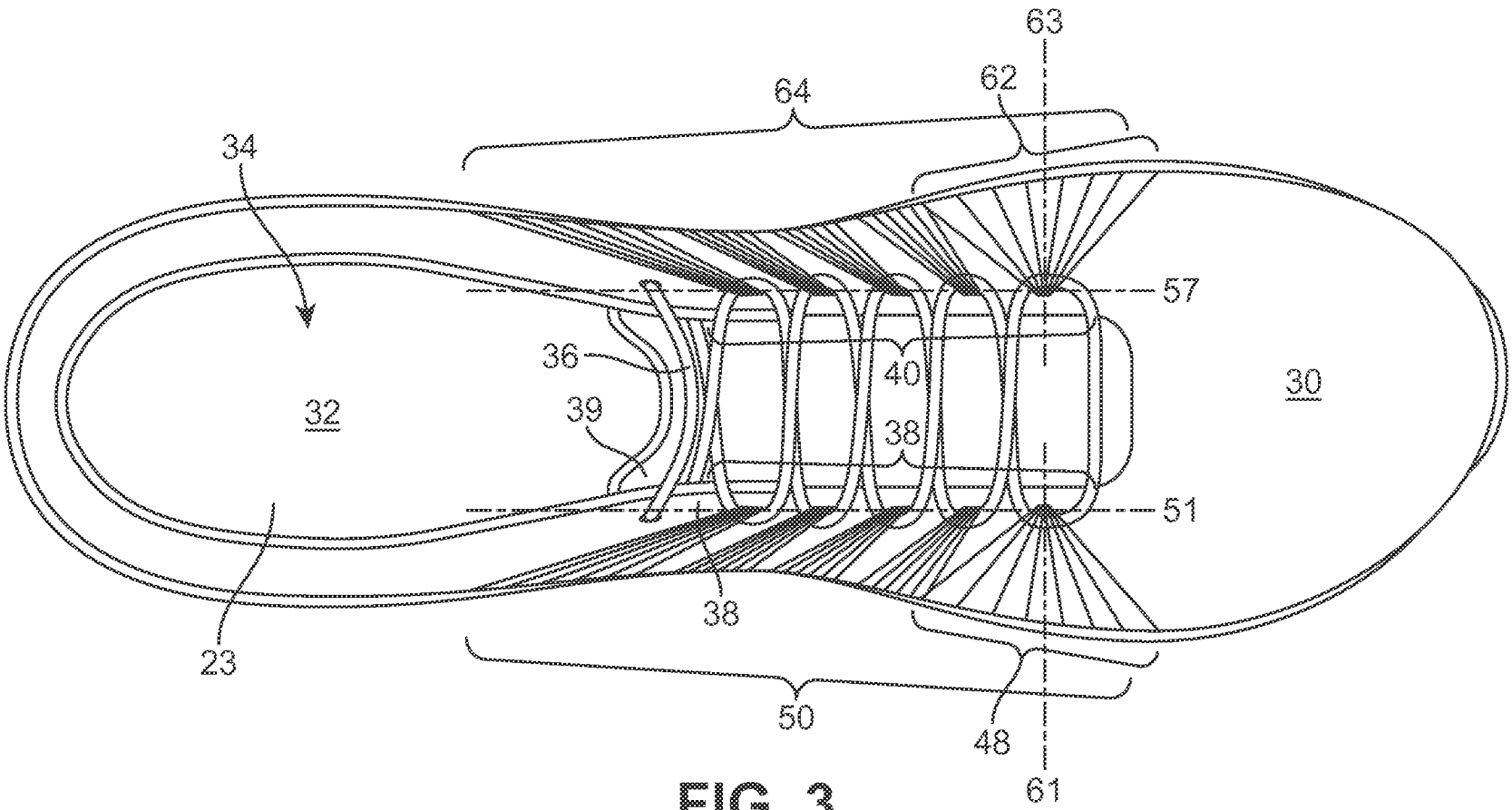
FIG. 3 is a top plan view of the article of footwear.

FIGS. 1-3 depict various views of an article of footwear 10, also referred to as "footwear 10," according to an embodiment set forth herein. FIG. 1 is a lateral side elevational view of footwear 10 incorporating a plurality of looped tensile strand elements or groups, collectively, lateral strand element group 50 (or lateral group 50). FIG. 2 is a medial side elevational view of footwear 10 incorporating a second plurality of looped tensile strand elements or groups, collectively, medial strand element group 64 (medial group 64). FIG. 3 is a top plan view of footwear 10. As depicted, footwear 10 includes a sole structure 20 and an upper 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot. Heel region 13 corresponds with rear portions of the foot, including the calcaneus bone. Lateral side 14 and medial side 15 extend through each of regions 11-13 and correspond with opposite sides of footwear 10 as depicted in FIGS. 1 and 2, respectively. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 at lasting margin 24 and extends between the foot and the ground when footwear 10 is worn. The primary elements of sole structure 20 are a midsole 21, an outsole 22 and a sockliner 23 (depicted in FIGS. 3 and 4). Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. In additional cases, outsole 22 may be formed from leather, a polymer, or other durable material known to skilled artisans. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. For example, footwear 10 may be constructed without a midsole 21 or may be constructed with additional layers between upper 30 and sole 20. Accordingly, the structure and features of sole structure 20 or any sole structure utilized with upper 30 may vary considerably.

Upper 30 defines a void 32 within footwear 10 for receiving and securing a foot relative to sole structure 20. Void 32 is shaped to accommodate the foot and extends along the lateral side of the foot, along the medial side of the foot, over the foot, around the heel, and under the foot. Access to void 32 is provided by an ankle opening 34 located in at least heel region 13. Footwear 10 may also include a fastening region 38 incorporating a fastening system for securing footwear 10 to the foot. In one embodiment, a lace 36 extends through various apertures, such as plurality of lateral strand loops 52 and plurality of medial strand loops 66, and permits the wearer to modify dimensions of upper 30 to accommodate the proportions of the foot. More particularly, lace 36 permits the wearer to tighten upper 30 around the foot, and lace 36 permits the wearer to loosen upper 30 to facilitate entry and removal of the foot from the void (i.e., through ankle opening 34). In other cases, other types of fastening systems may be used, such as fastening systems incorporating hook-and-loop closures, buckles, or other contemplated closures. In addition, upper 30 may include a tongue portion 39 at a top area of footwear 10 that extends under lace 36.

Various portions of upper 30 may be formed from one or more of a plurality of material elements (e.g., textiles, polymer sheets, foam layers, leather, synthetic leather) that are stitched or bonded together to form the void 32 within footwear 10. Upper 30 may also incorporate a heel counter that limits heel movement in heel region 13 or a wear-resistant toe guard located in forefoot region 11.

Tensile Strand Elements

Although a variety of material elements or other elements may be incorporated into upper 30, areas of one or both of lateral side 14 and medial side 15 may incorporate provisions to add strength and resist stretch along portions of upper 30. As seen in FIGS. 1 and 3, in at least one configuration, lateral side 14 of footwear 10 may include a plurality of tensile strand groups or elements, e.g., strand element 40, strand element 42, strand element 44, strand element 46 and strand element 48, collectively referred to as lateral group 50. As seen in FIGS. 2 and 3, medial side 15 of footwear 10 may also include a plurality of tensile strand groups or elements, e.g., strand element 54, strand element 56, strand element 58, strand element 60 and strand element 62, collectively referred to as medial group 64.

According to aspects set forth herein, each strand element of lateral group 50 and medial group 64 may be comprised of multiple single tensile strands looped at or near a fastening region 38 of footwear 10 and secured near the convergence of upper 30 and midsole 21. For simplicity, the following discussion will focus on lateral strand element 44, as labeled and referenced in FIGS. 1, 3 and 4, and medial strand element 58, as labeled and referenced in FIGS. 2-4. However, it should be understood that the following discussion applies to each strand element of lateral group 50 and medial group 64.

To create stability, strand elements as described herein may be formed from a plurality of tensile strands that are secured near midsole 21. In some cases, for example, each strand element may comprise two or more individual strands, creating two or more loops in fastening region 38. As would be understood by those skilled in the art, to create more stability across the strand element, more individual tensile strands could be incorporated into the strand element system. By incorporating additional individual strands into a strand element, not only may tension be applied to a larger area along lasting margin 24, by additional stability may be incorporated into the strand element loop that receives lace 36. In at least one configuration, each strand element may be comprised of six tensile strands. According to the embodiment depicted in FIGS. 1-4, the strand elements of lateral group 50 and medial group 64 are comprised of six tensile strands, each of which is secured near midsole 21 at both ends and looped near fastening region 38 at or near a midpoint.

In FIGS. 1 and 2, the tensile strands of lateral strand element 44 and medial strand element 58 have been labeled as lateral strands 78 and medial strands 72, respectively, and will be referred to in the following discussion. Again, lateral strand element 44 and medial strand element 58, including lateral strands 78 and medial strands 72, are exemplary of the multiple strands making up lateral group 50 and medial group 64, and thus the following discussion is not limited to lateral strands 78 or medial strands 72. As will be discussed in more detail in the following paragraphs, lateral strands 78 and medial strands 72 may be formed from a portion of one embroidered strand that is looped multiple times and secured at the ends. In other cases, as set forth in further embodiments, each strand of a strand element may be a separate singular strand that is looped once and secured at the ends. In either case, the strands may be secured at a position near the intersection of the midsole and upper such that portions of the strands that extend across upper 30 remain unattached to upper 30.

Figure 4:
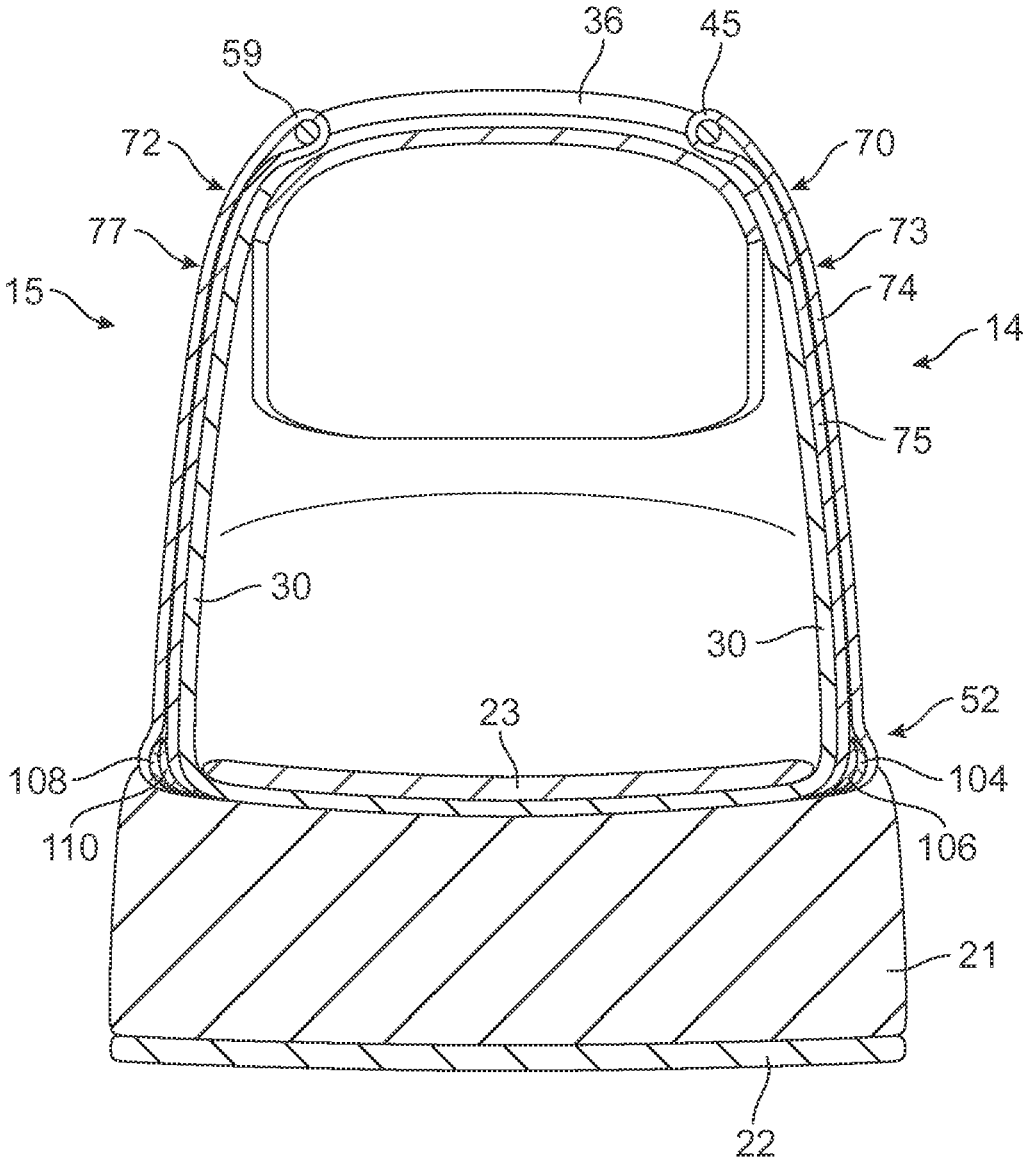
FIG. 4 is a cross-sectional view of the article of footwear as defined by section line 4 in FIGS. 1-2.

FIG. 4 depicts a cross-sectional view of footwear 10 as taken across cross-sectional line 4 shown in FIGS. 1 and 2. As may be seen in FIG. 4, a cross-section of lateral strands 78 and medial strands 72 are depicted on lateral side 14 and medial side 15, respectively. Specifically, singular tensile strand 73 of lateral strands 78 and singular tensile strand 77 of medial strands 72 are shown. Referring to lateral side 14 in FIG. 4, the ends of singular tensile strand 73 may be attached at an attachment area 52 between upper 30 and midsole 21.

Referring to the configuration depicted in FIG. 4, singular tensile strand 73 may be positioned such that an innermost portion 75 of singular tensile strand 73 lays against upper 30 and an outermost portion 74 of singular tensile strand 73 may be outwardly exposed. Lateral strands 78 may also include loops 45 at or near fastening region 38 for receiving a lace or other fastening system. As may be appreciated from FIGS. 3 and 4, in at least one configuration, loops 45, as well as the plurality of lateral strand loops 52, may be positioned such that an axis 51 running through loops 45 is approximately parallel to upper 30. Similarly, the plurality of medial strand loops 66 may be positioned such than an axis 57 running through them is approximately parallel to upper 30. In other words, when lace 36 passes through each of the plurality of lateral strand loops 52 and the plurality of medial strand loops 66, lace 36 follows a path that is parallel to upper 30. This allows for lace 36 to follow a natural path as it engages with the plurality of lateral strand loops 52 and the plurality of medial strand loops 66.

The strand elements of lateral group 50 and medial group 64 may be spaced to provide stability across regions of upper 30. In some cases, for example, the attachment points of the singular strands of each strand element may be spaced further apart to provide tension across a larger area of upper 30 along lasting margin 24. In other cases, the spacing of the attachment points may be closer together to provide a more concentrated tensile force. As may be seen in FIGS. 1 and 2, lateral strand element 48 and medial strand element 62, both straddling toe region 11 and midfoot region 12, may have a predominately tent-like deflection from the strand loops down to lasting margin 24. In particular, referring to lateral strand element 48 (recognizing that medial strand element 62 may have a similar configuration), strands 71 deflect from loops 49 to lasting margin 24 across lasting margin 24 by a distance 53. The deflection of lateral strand element 48 in a tent-like shape across lasting margin 24 creates tension at loops 49, as well as stability across distance 53 of upper. In contrast, referring to lateral strand element 44 (also recognizing that medial strand element 58 may have a similar configuration), strands 78 deflect from loops 45 to lasting margin 24 across lasting margin 24 by a distance 55 that is smaller than distance 53. The more condensed deflection of lateral strand element 44 across lasting margin 24 creates a more concentrated tension along midfoot region 12. Thus, those skilled in the art will recognize that the spacing of the tensile strands and the tensile strand elements may be varied to effect the tension and stability that may be provided by the various strand elements across upper 30.

In addition to spacing of the individual strands, the deflection angle of the strand elements from the strand loops down to the attachment points of the strands along lasting margin 24 may be altered to vary how tension is applied when the strand loops are engaged by lace 36. For example, strand elements may deflect down at an angle that is approximately perpendicular to sole 22 or may deflect down at an angle that is not perpendicular to sole 22. Furthermore, the deflection angle may vary among the tensile strand elements in a strand element group. Referring to FIGS. 1-3, for example, according to the embodiment of footwear 10, lateral strand element 48 and medial strand element 62 both deflect downward in a manner that is approximately perpendicular to an axis defined by sole 22. In particular, lateral strand element 48 deflects downward approximately along perpendicular axis 61 and medial strand element 62 deflects downward approximately along perpendicular axis 63. In contrast, for example, referring again to FIGS. 1 and 2, lateral strand element 44 deflects downward approximately along axis 65 and medial strand element 67 deflects downward approximately along axis 67, both of which are offset at an angle 69 to an axis formed by sole 22. In the former case, tension is applied along the respective perpendicular axis (axis 61 and axis 63), and across the intersection of the respective axis with lasting margin 24. In the latter case, tension is applied along the respective angled axis (axis 65 and axis 67), and across the intersection of the respective axis with lasting margin 24. Thus, by adjusting the angle at which the strand elements deflect down from lace 36, the tension applied across midfoot region 12 of footwear 10 may be varied.

Tensile strand elements as set forth herein may be formed using a variety of techniques known in the art. For example, in some cases, the tensile strand elements may be formed from one singular tensile looped multiple times and secured to an underlying material using machine- or hand-stitching, an embroidery process or an adhesive. In other cases the tensile strand elements may be formed from multiple singular tensile strands that are looped and secured at the ends via an adhesive or machine- or hand-stitching. Exemplary manufacturing techniques are discussed in more detail below.

Embroidery Process

In at least one configuration, the strand elements may be formed from one strand that is embroidered to create a plurality of strands within the strand element. FIGS. 5A-5G depict the process by which a strand may be used to create strand elements that may be incorporated into articles of footwear as described herein. In particular, FIGS. 5A-5G depict an example of a method for manufacturing each of the tensile strand elements in lateral group 50 and medial group 64 of the embodiment depicted in FIGS. 1-4. In general, the various steps utilized to form lateral group 50 are similar to the steps utilized to form medial group 64. Accordingly, the following discussion focuses upon the manufacturing method for exemplary lateral strand element 44 of lateral group 50, with an understanding that the remaining tensile strand elements of lateral group 50 and the tensile strand elements of medial group 64 may be manufactured in a similar manner.

As depicted in FIGS. 5A-5G, the tensile strand elements described herein, e.g., lateral strand element 44, may be formed through an embroidery process, which may be performed by either machine or hand. With regard to machine embroidery, a variety of conventional embroidery machines may be utilized to form lateral strand element 44. In general, embroidery machines form patterns or designs by repeatedly securing a thread or strand to various locations of a base material such that portions of the thread extend between the locations and are visible. More particularly, an embroidery machine forms a series of lock-stitches by (a) piercing a first location of a base layer with a needle to pass a first strand through the base layer 80, (b) securing a first strand 70 with another strand that passes through the first loop, (c) moving the needle to a second location such that strand 70 extends from the first location to the second location and is visible on a surface of base layer 80, (d) piercing the second location of base layer 80 with the needle to pass a second loop of strand 70 through base layer 80, and (e) securing the second loop of strand 70 with the other strand that passes through the second loop. Accordingly, the embroidery machine operates to secure strand 70 to two defined locations and also extend strand 70 between the two locations. By repeatedly performing these steps, embroidery is formed by strand 70 on base layer 80.

Conventional embroidery machines may form patterns or designs on base layer 80 by forming satin-stitches, running-stitches, or fill-stitches, each of which may utilize a lock-stitch to secure strand 70 to base layer 80. Satin-stitches are a series of zigzag-shaped stitches formed closely together. Running-stitches extend between two points and are often used for fine details, outlining, and underlay. Fill-stitches are series of running stitches formed closely together to form different patterns and stitch directions, and fill-stitches are often utilized to cover relatively large areas. With regard to satin-stitches, conventional embroidery machines generally limit satin stitches to twelve millimeters. That is, the distance between a first location and a second location where a thread is secured to a base layer is conventionally limited to twelve millimeters when an embroidery machine is forming satin-stitches. Conventional satin-stitch embroidery, therefore, involves threads that extend between locations separated by twelve millimeters or less. Forming embroidered element 71, however, may require that the embroidery machine be modified to form satin-stitches extending between locations spaced by more than twelve millimeters. In some aspects of the present disclosure, stitches may be spaced by more than five centimeters, for example. That is, a thread or strand may be continuously exposed on a front surface 85 of base layer 80 by more than twelve millimeters or by more than five centimeters, for example.

Figure 5A:
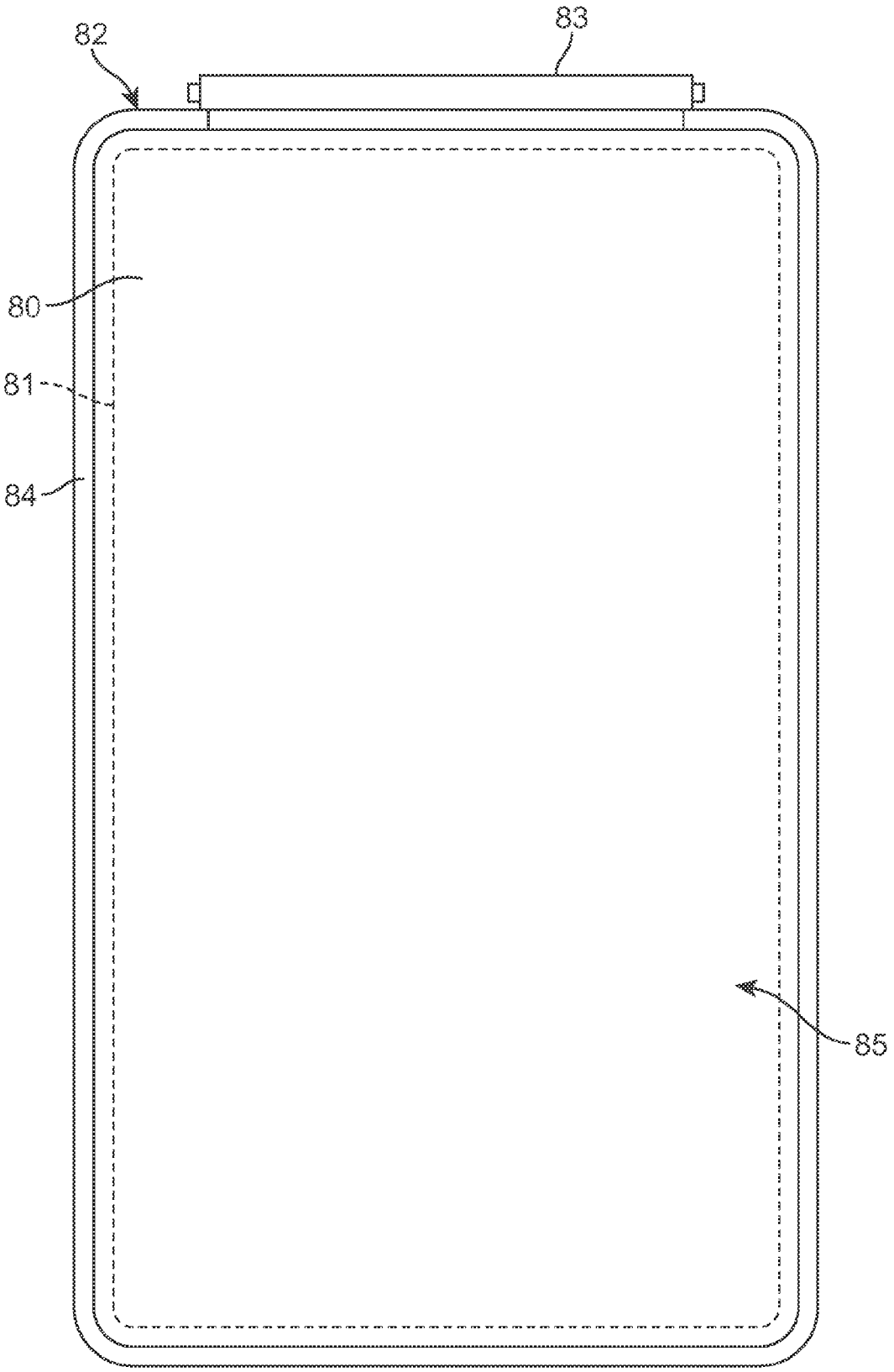
FIGS. 5A-5G are top plan views illustrating a procedure for forming a tensile strand element.

With respect to FIG. 5A, base layer 80 is depicted in combination with a hoop 82, which has the configuration of a conventional rectangular hoop utilized in embroidery operations. The primary elements of hoop 82 are an outer ring 84, an inner ring 81, and a tensioner 83. As is known in the art, outer ring 84 extends around inner ring 81, and peripheral portions of base layer 80 extend between outer ring 84 and inner ring 81. Tensioner 83 adjusts the tension in outer ring 84 such that inner ring 81 is positioned within outer ring 84 and base layer 80 is firmly held in place. In this configuration, a central area of base layer 80 positioned on a single plane and may be in slight tension in order to ensure that base layer 80 is securely-positioned during further steps of the manufacturing process. In general, therefore, hoop 82 is utilized as a frame that securely-positions base layer 80 during the embroidery operation that forms first embroidered element 71.

Figure 5B:
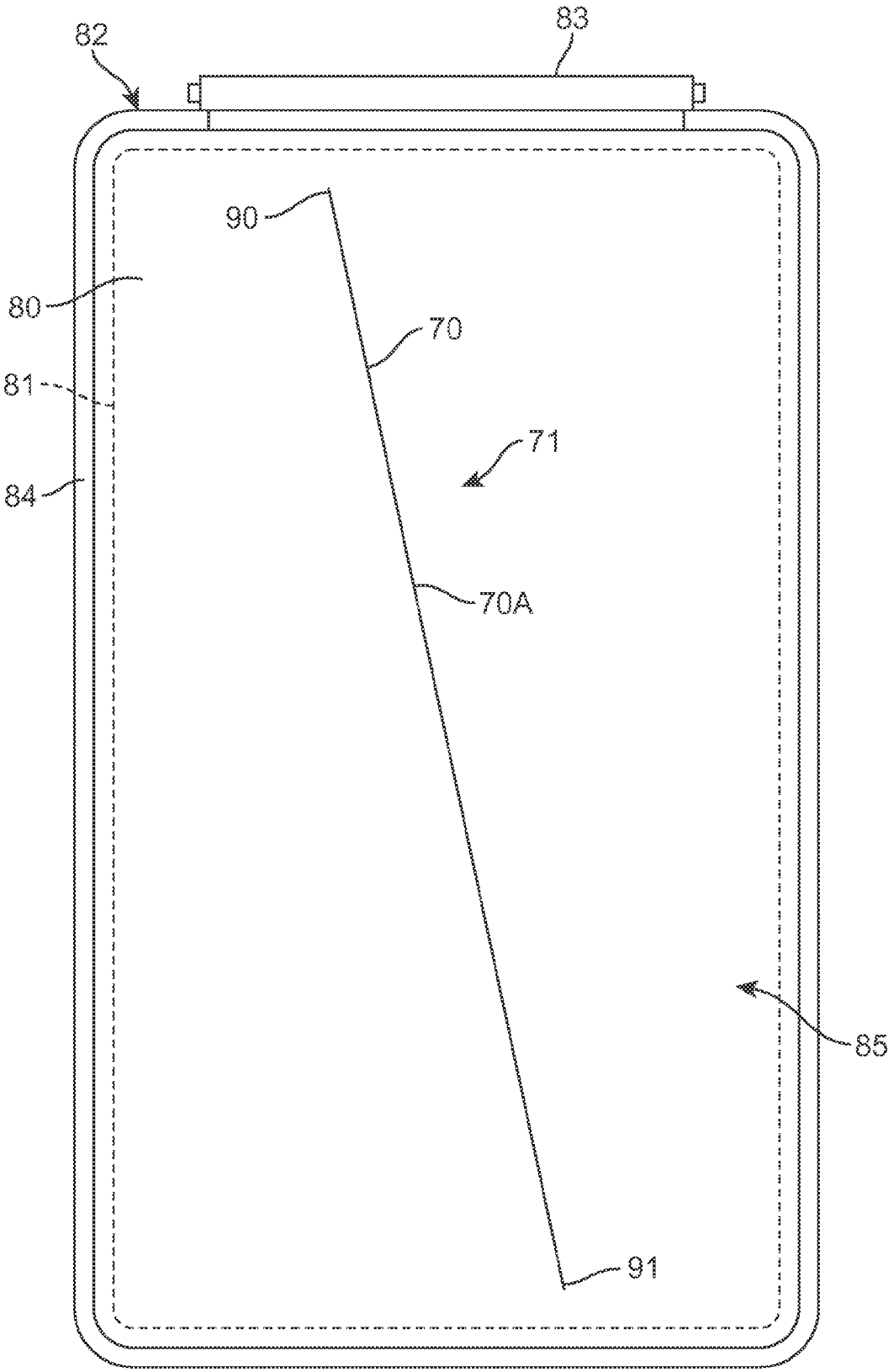
Figure 5C:
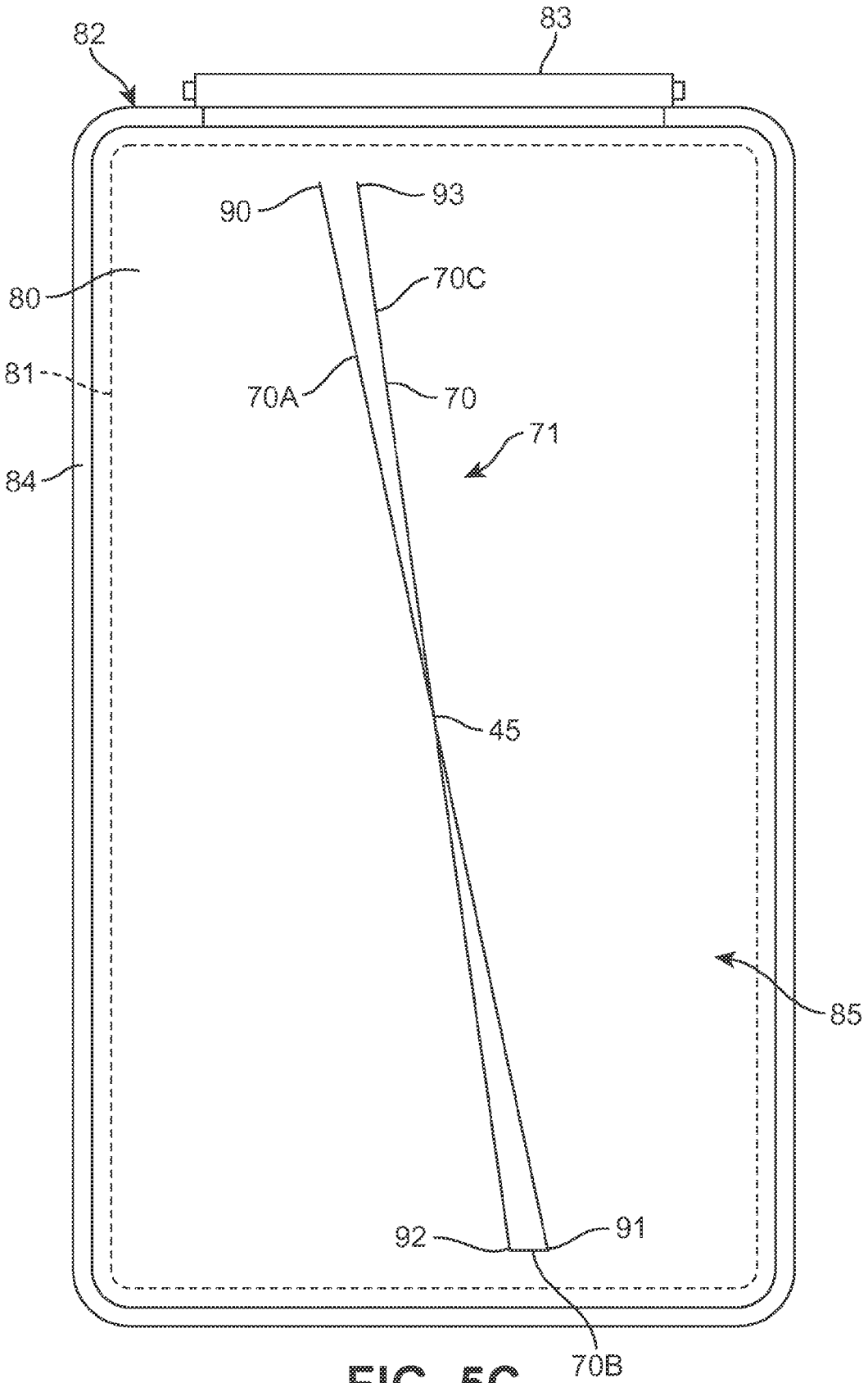
Figure 5D:
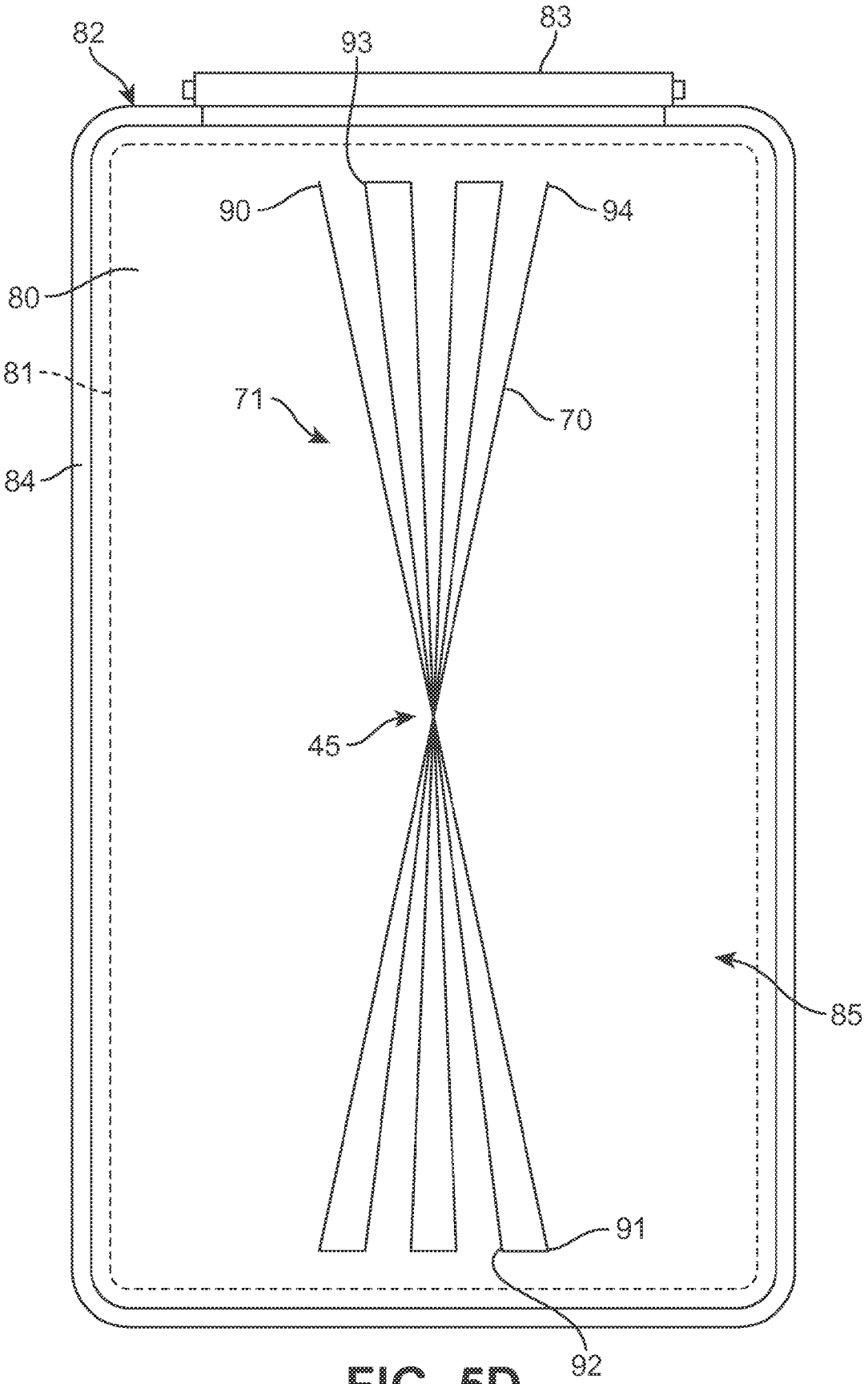

Once base layer 80 is secured within hoop 82, an embroidery machine begins locating and securing strand 70 to base layer 80. Initially, strand portion 70A may be formed. Referring to FIG. 5B, a portion 70A of strand 70 extends between two points, end point 90 and end point 91. End point 90 and end point 91 of portion 70A are secured with a lock-stitch, and the central area of portion 70A (i.e., the area of portion 70A other than end point 90 and end point 91) lies adjacent to a front surface 85 of base layer 80 and is unsecured to base layer 80. That is, the central area of portion 70A is continuously exposed on the front surface 85 of base layer 80. The embroidery machine may then form a relatively short portion 70B of strand 70, between end point 91 and end point 92. The embroidery machine also forms another portion, portion 70C, that extends between end point 92 and end point 93 and crosses portion 70A at midpoint 45, as depicted in FIG. 5C. Similar to portion 70A, the central area of portion 70C is continuously exposed on the surface of base layer 80. This general procedure then repeats until strand 70 is completed at an end point 94, as depicted in FIG. 5D. According to the embodiment depicted in FIGS. 5A-5G, six unsecured portions of strand 70 are created on base layer 80. However, the general procedure may be applied to create more or fewer freestanding or unsecured strand portions when creating a tensile strand element, such as strand element 71.

Figure 5E:
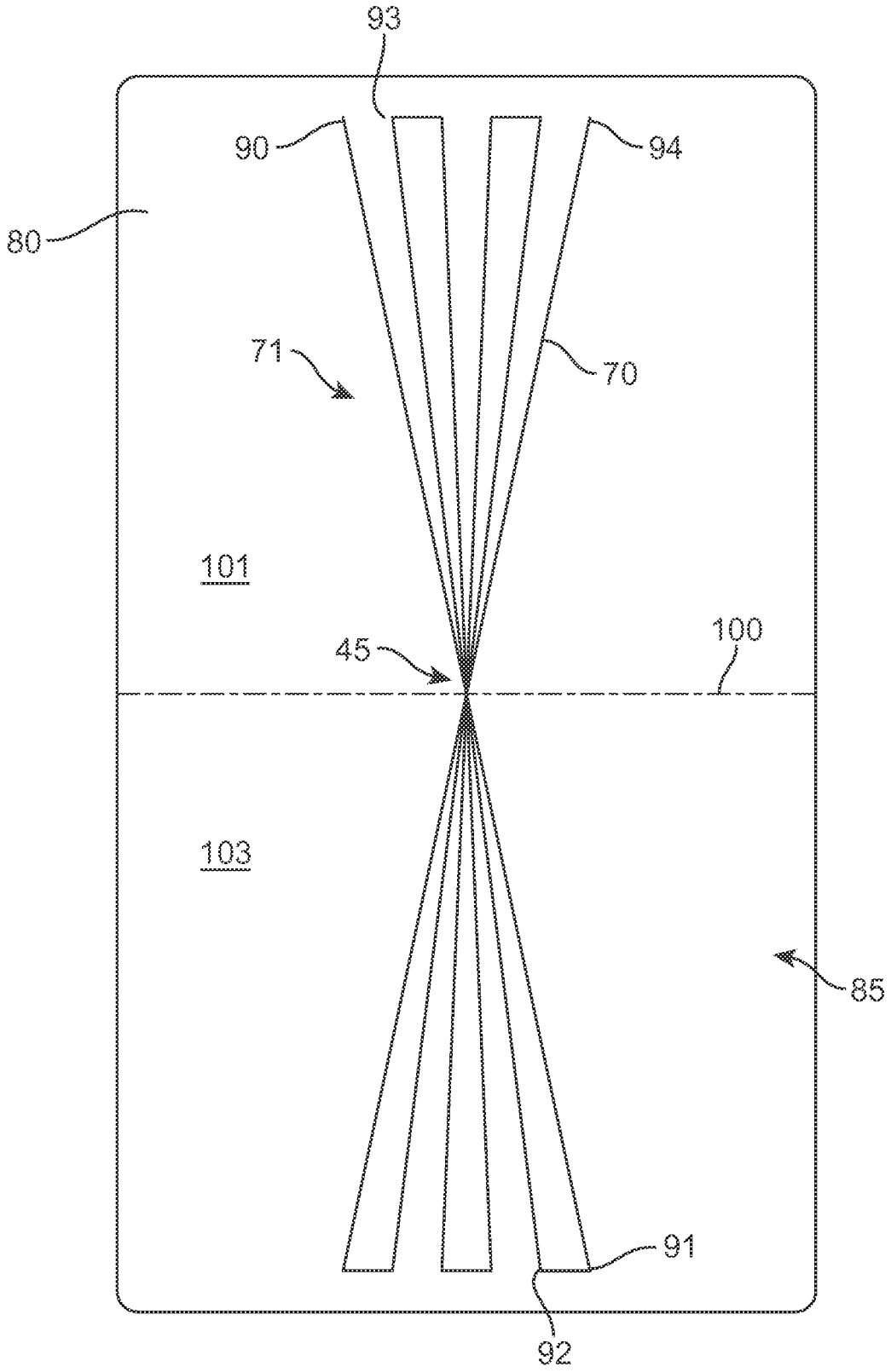
Figure 5F:
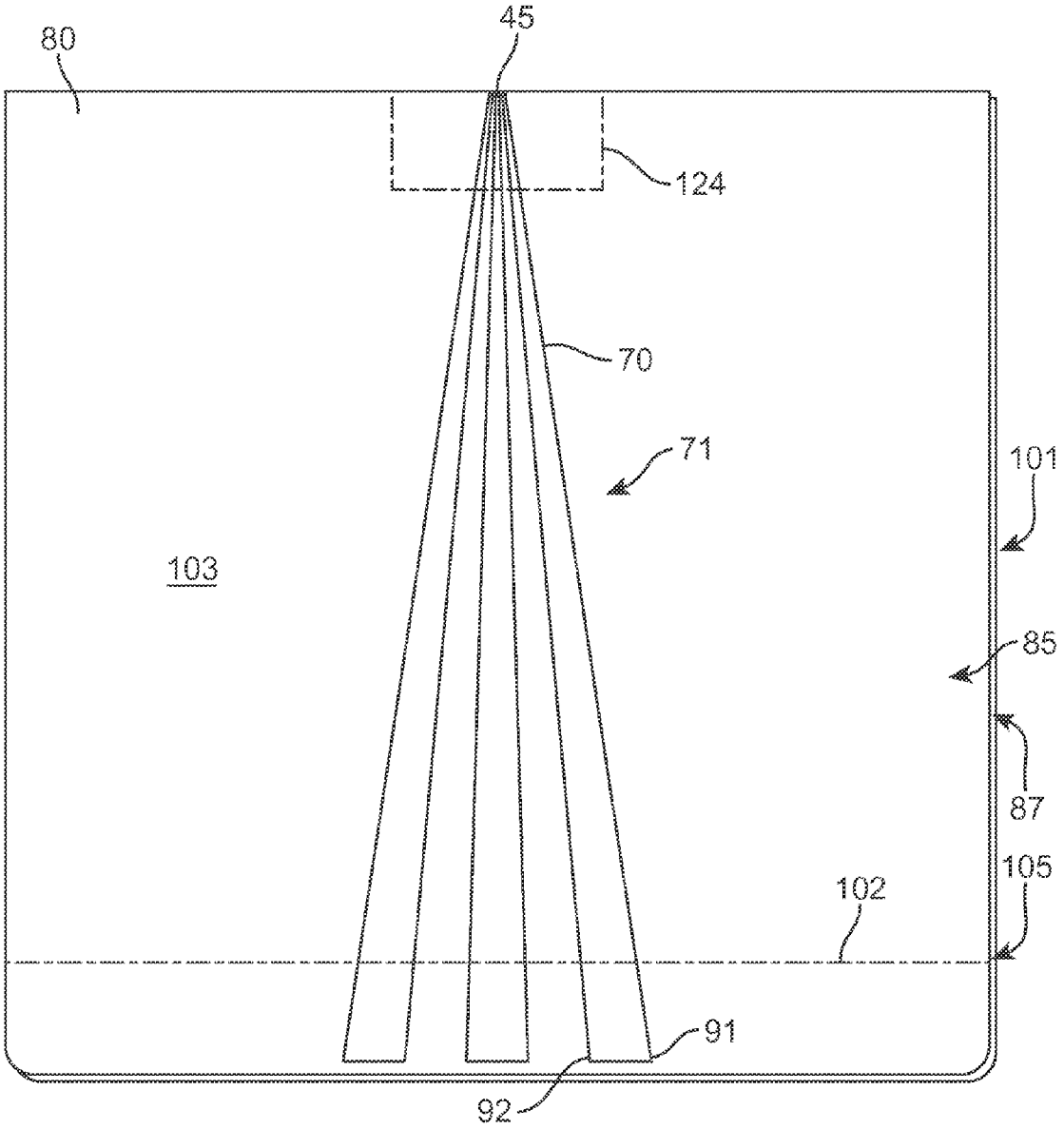

After the embroidery process depicted in FIGS. 5B-5D is complete, hoop 82 may be removed so that only base layer 80 and embroidery element 71 remains, as shown in FIG. 5E. At this point, embroidery element 71 and base layer 80 may be folded at or near the midpoint 45 of embroidery element 71, i.e., at fold line 100. In particular, in the depicted embodiment, an upper region 101 of base layer 80 is folded behind a lower region 103 of base layer 80 as depicted in FIG. 5F such that a front surface 85 of base layer 80 is exposed and a back surface 87 of base layer 80 is enclosed.

Figure 5G:
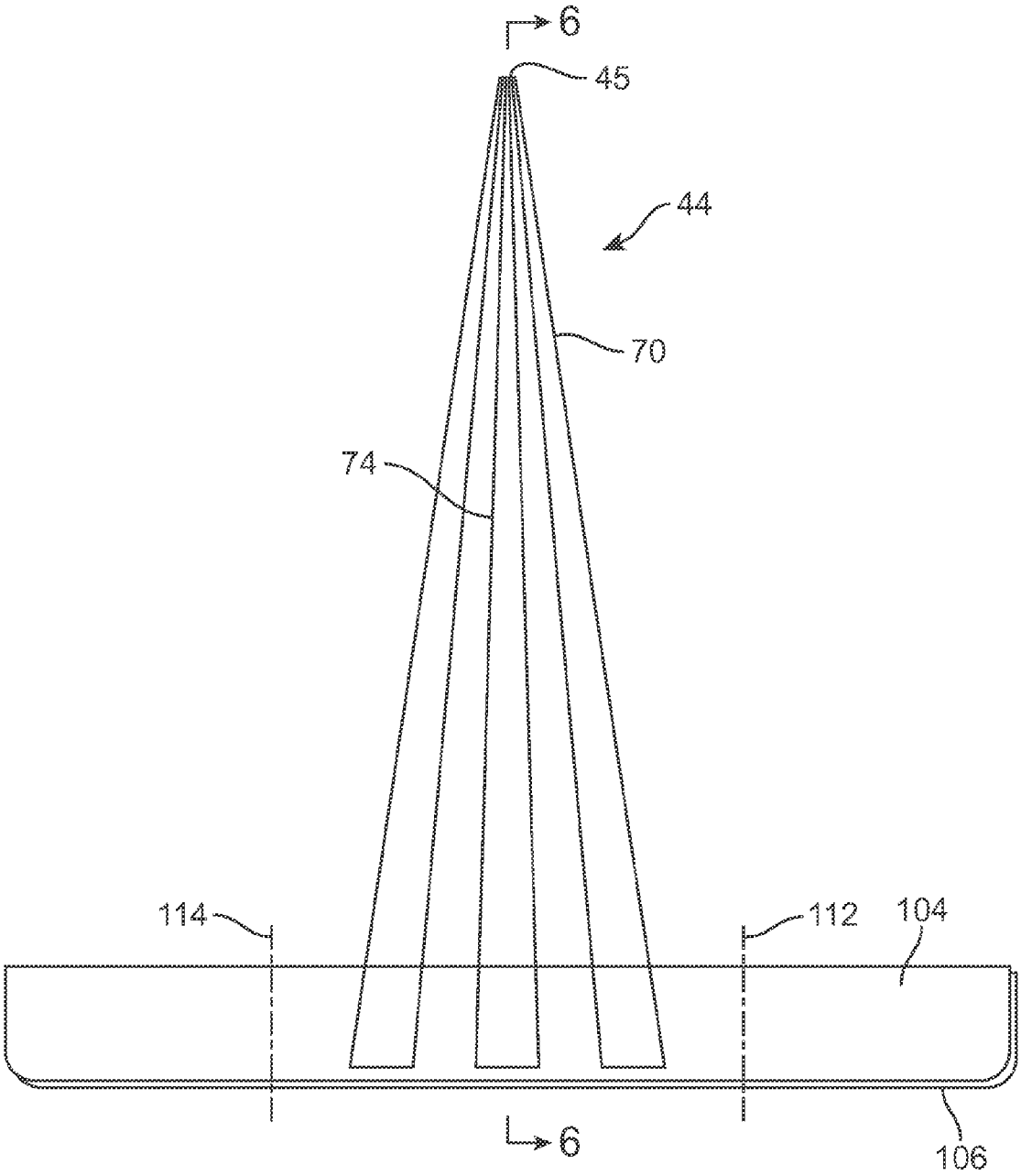

After base layer 80 is folded, a portion of base layer 80 is cut away to form lateral strand element 44. Referring to FIGS. 5F and 5G, lower region 103 of base layer 80 may be cut away at cut line 102 and upper region 101 of base layer 80 may be cut away at cut line 105. Since strand 70 is secured at its end points in the configuration embodied in FIGS. 5B-5G (e.g., end point 91, end point 92 and end point 94 of lower region 103, and end point 90 and end point 93 or upper region 101), the portions of strand 70 that lie between the end points are unattached to base layer 80. Thus, as seen in FIG. 5G, when base layer 80 is cut away at cut lines 102 and 105, the secured endpoints of strand 70 remain attached to a portion of base layer 80, an enforcement strip 104 and an enforcement strip 106, and the remainder of strand 70 is unattached. Additionally, in some cases, the length of enforcement strip 104 may be shortened by cutting away the ends at cut line 112 and cut line 114. Enforcement strip 106 may be shortened in a similar manner as enforcement strip 104 (the cut lines for enforcement strip 106 are not shown).

As set forth above, FIGS. 5A-5G depict an embroidery process for manufacturing tensile strand elements as set forth herein. It should be understood that the embroidery process set forth above and in FIGS. 5A-5G is an example of one technique for forming tensile strand elements and those skilled in the art will recognize other techniques that may be used, or that variations of the above technique are possible. For example, in an alternative configuration, the embroidery process set forth above may be carried out using two strips similar to enforcement strip 104 and enforcement strip 106 for securing the ends of a tensile strand instead of using a full base layer (i.e., base layer 80). Additionally, the step of folding outlined above and depicted in FIG. 5F may be completed after lower region 103 and upper region 101 are cut away to reveal enforcement strip 104 and enforcement strip 106. Again, those skilled in the art will recognize that the specific configurations and manufacturing techniques set forth herein may be varied and still fall within the spirit and scope of the present disclosure.

Figure 6:
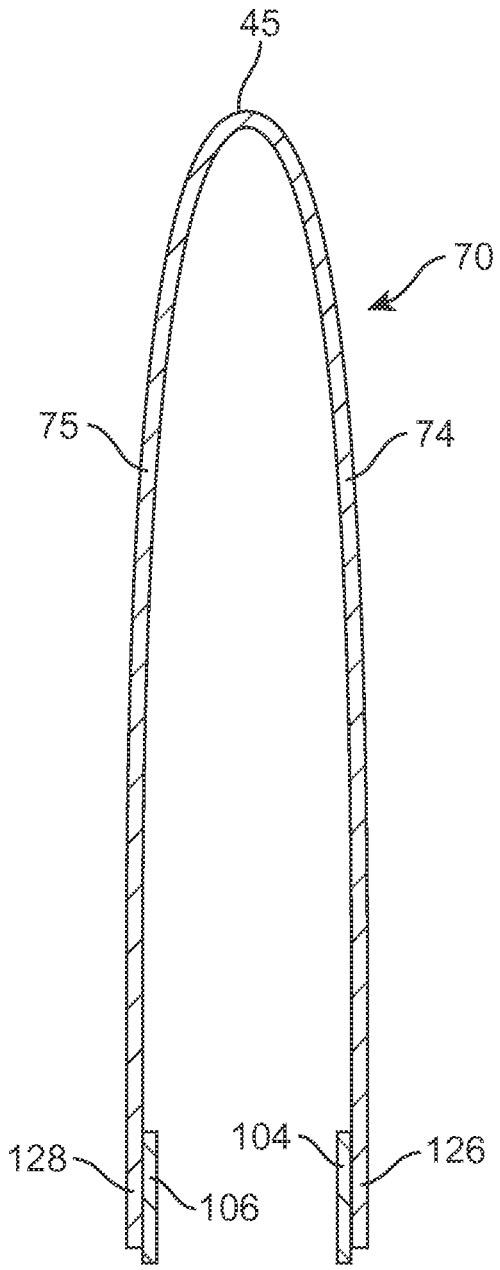
FIG. 6 is a cross-sectional view of the tensile strand element as defined by section line 6 in FIG. 5G.

FIG. 6 depicts a cross-section of lateral strand element 44 as defined by line 6-6 in FIG. 5G. As can be seen in FIGS. 1-4 and 6, in at least one configuration, outermost strand 74 and innermost strand 75 are co-planar. In other words, outermost strand 74 lies directly on top of innermost strand 75 when looking at lateral side 14 of the embodiment of footwear 10. Further, along a longitudinal direction directed from a toe region 11 to a heel region 13, an attachment point 126 of outermost strand 74 is co-located with an attachment point 128 of innermost strand 75. The same can be seen in FIG. 4, where lateral strand element 44 is shown in cross section on footwear 10. In other configurations, the strand element could be shifted such that the innermost and outermost strands are not coplanar. For example, FIG. 10, discussed in more detail below, depicts an alternative embodiment wherein a lateral strand element 1344 is positioned such that a first portion 1346 of lateral strand element 1344 is attached closer to a toe region 1311 of footwear 1310 and a second portion 1348 of lateral strand element 1344 is attached closer to a heel region 1313 of footwear 1310.

The tensile strands set forth herein may be formed from any generally one-dimensional material. As utilized with respect to the present disclosure, the term "one-dimensional material" or variants thereof is intended to encompass generally elongate materials exhibiting a length that is substantially greater than a width and a thickness. Accordingly, suitable materials for the tensile strands set forth herein include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as strands according to embodiments set forth herein, fibers have a relatively short length and generally go through spinning or twisting processes to produce a strand of suitable length. An individual filament utilized for tensile strands as set forth herein may be formed form a single material (i.e., a monocomponent filament) or from multiple materials (i.e., a bicomponent filament). Similarly, different filaments may be formed from different materials. As an example, yarns utilized for the tensile strands may include filaments that are each formed from a common material, may include filaments that are each formed from two or more different materials, or may include filaments that are each formed from two or more different materials. Similar concepts also apply to threads, cables, or ropes. The thickness of each of the tensile strands may also vary significantly to range from 0.03 millimeters to more than 5 millimeters, for example.

Figure 7:
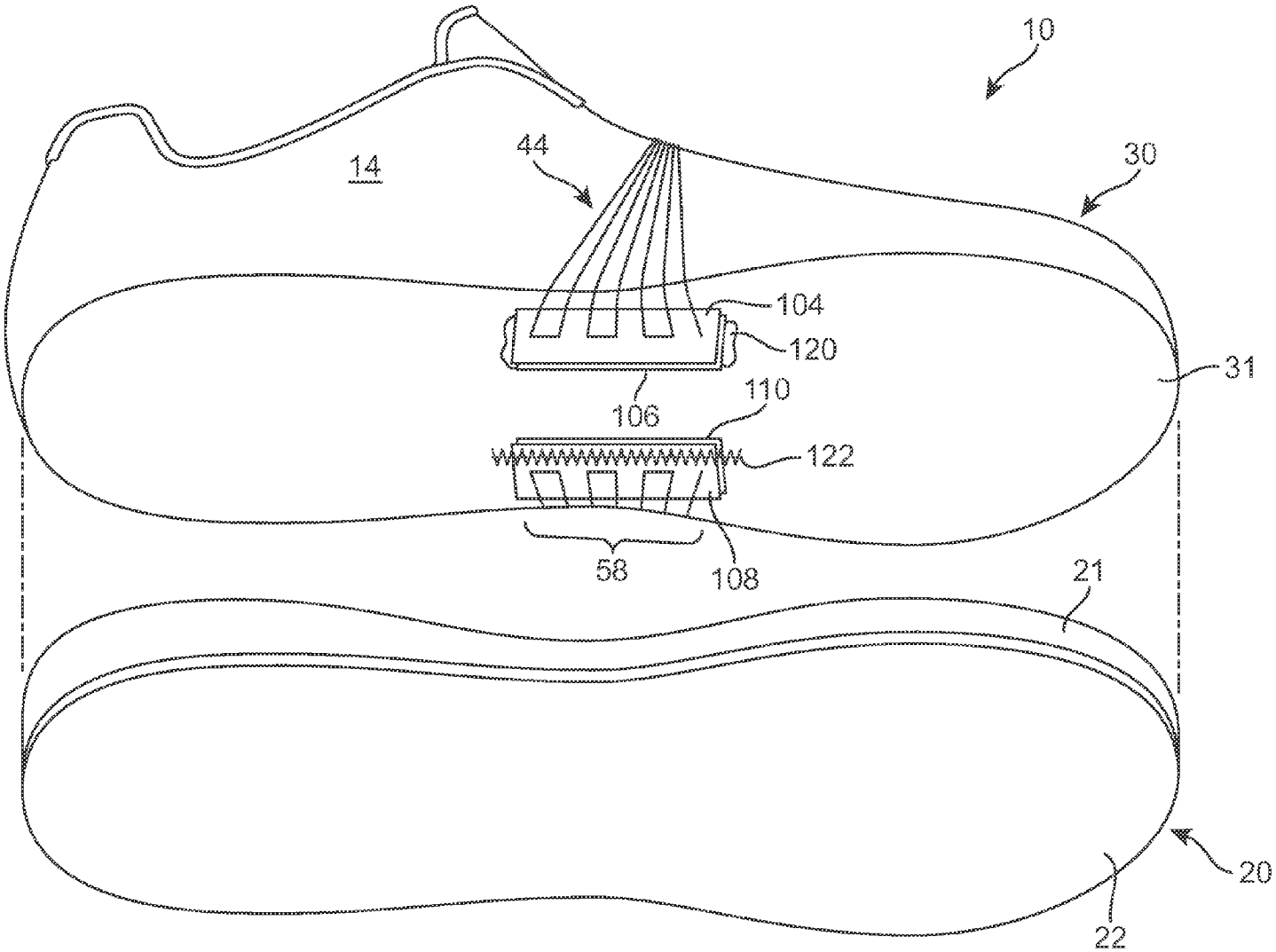
FIG. 7 is an exploded bottom perspective view of portions of an article of footwear incorporating tensile strand elements.

The tensile strand elements of lateral group 50 and medial group 64 may be attached to footwear 10 in a variety of ways to provide support to upper 30. In at least one configuration, exemplary lateral strand element 44 and exemplary medial strand element 58 may be attached on an underside 31 of upper 30, between upper 30 and midsole 21, before upper 30 is merged with sole portion 20 during the manufacture of footwear 10. FIG. 7 depicts attachment techniques for exemplary lateral strand element 44 and exemplary medial strand element 58 (other strand elements, not shown, may be similarly attached). According to at least one embodiment, lateral strand element 44 may be secured to underside 31 of upper 30 by securing enforcement strip 104 and enforcement strip 106, together, to underside 31. Likewise, medial strand element 58 may be secured to underside 31 of upper 30 by securing enforcement strip 108 and enforcement strip 110, together, to underside 31.

Enforcement strip 104 and enforcement strip 106 of lateral strand element 44, and enforcement strip 108 and enforcement strip 110 of medial strand 58 may be secured using techniques known in the art. In at least one configuration, the tensile strands may be secured to upper 30 with an adhesive known in the art, such as a polymer adhesive. For example, enforcement strip 104 and enforcement strip 106 in FIG. 7 are secured with an adhesive 120. The tensile strands may also be secured by other known methods such as by machine- or hand-stitching. For example, enforcement strip 108 and enforcement strip 110 in FIG. 7 are secured with a row of stitching 122. Once the tensile strand elements have been secured to upper 30 as described above or by other known methods, upper 30 may be attached to sole 20 using techniques well-known in the art.

Figure 8A:
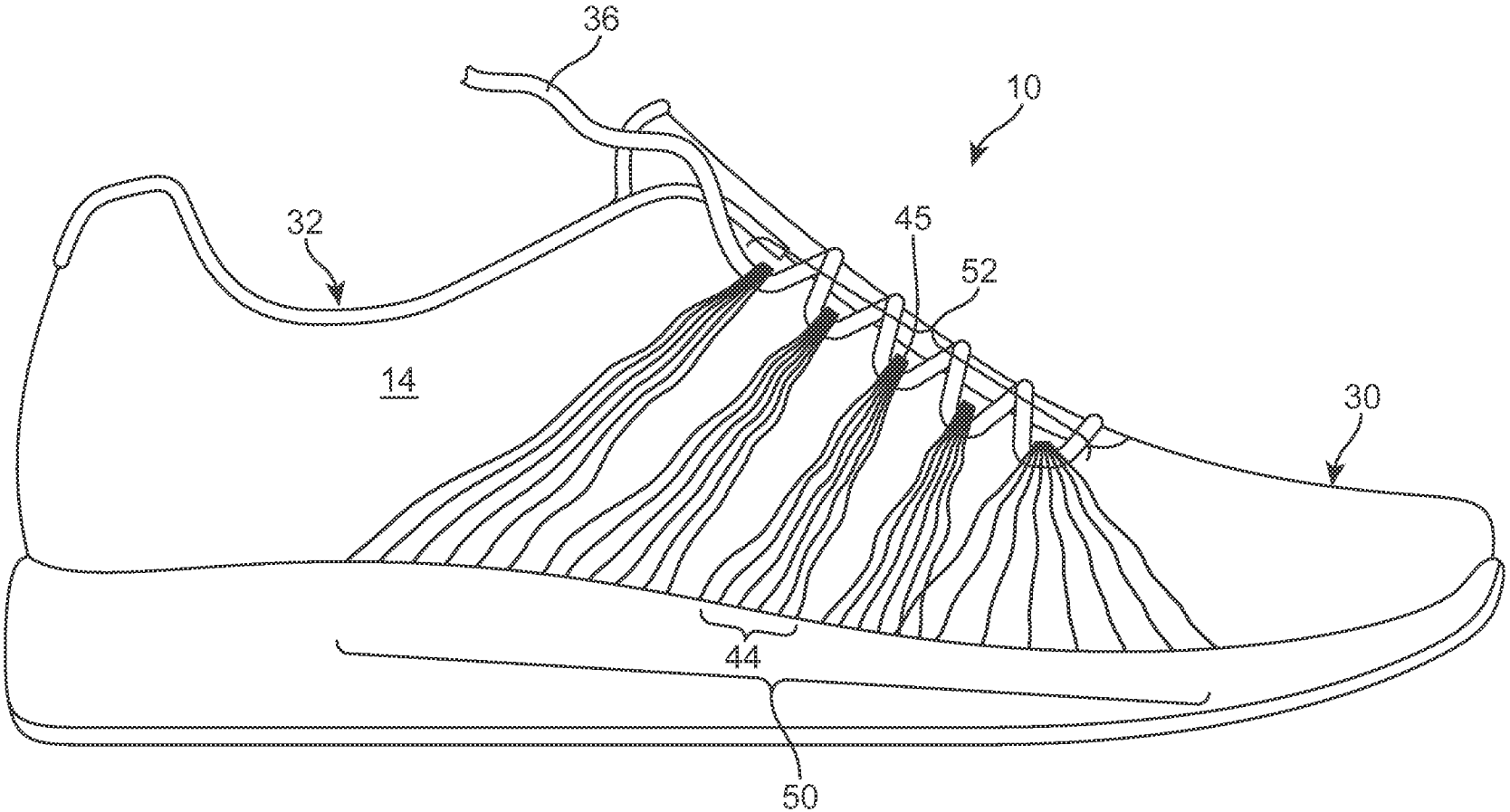
FIGS. 8A-8B are additional lateral side elevational views of the article of footwear incorporating tensile strand elements, as the tensile strand elements are engaged.
Figure 8B:
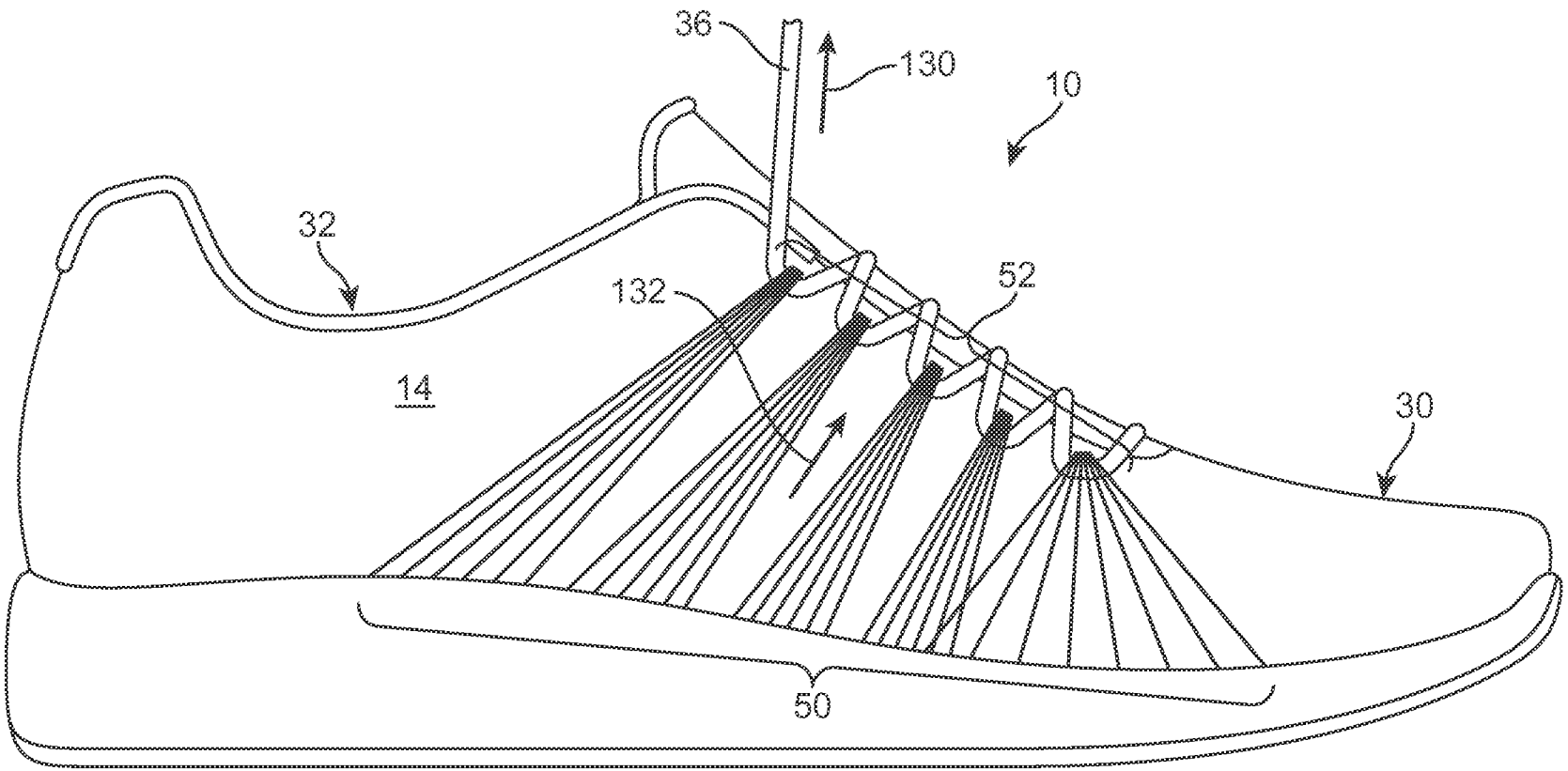

The tensile strand elements set forth herein, such as lateral group 50 and medial group 64 described above in relation to footwear 10, may provide added support and stability to upper 30. FIGS. 8A and 8B depict a lateral side elevational view of footwear 10 as lateral group 50 of the tensile strand elements are engaged by a footwear fastening system, in this case, lace 36. As may be seen in FIG. 8A, lace 36 is threaded through the upper portion or loop portion of each tensile strand element in lateral group 50. In particular, lace 36 engages with each strand element of lateral group 50 at lateral strand loops 52. In FIG. 8A, lace 36 is loose, and as a result, the tensile strands in lateral group 50 are slack.

FIG. 8B depicts lateral group 50 as lace 36 is pulled in direction 130, such as when footwear 10 would be fastened around a wearer's foot. As depicted in FIG. 8B, a wearer may insert a foot (not shown) in opening 32 of footwear 10 and pull on lace 36 in direction 130 to tighten footwear 10 around the foot. When pulled in direction 130, lace 36 engages the tensile strands in lateral group 50 (as well as medial group 64, not shown) to pull each tensile strand group against upper 30. In particular, lace 36 may be engaged with lateral group 50 at loops 52 such that as the wearer pulls in direction 130, the tensile strand elements of lateral group 50 and medial group 64 (not shown) may be pulled in a direction towards the wearer's foot, e.g. direction 132, effectively pulling upper 30 more snugly against the wearer's foot.

Thus, as can be understood from the embodiment described herein, lateral group 50 and medial group 64 may provide additional support along upper 30, and specifically, in mid-step region 12 of upper 30 as lace 36 is tightened. During walking, running, or other ambulatory activities, a foot within the void in footwear 10 may tend to stretch upper 30. Additional support may be beneficial in a variety of athletic and non-athletic contexts as described above, and may be particularly beneficial when upper 30 is constructed from a lightweight material with no intrinsic structure or support. That is, many of the material elements forming upper 30 may stretch when placed in tension by movements of the foot. Although lateral group 50 and medial group 64 may also stretch, when pulled tight as depicted in FIG. 8B, they may generally stretch to a lesser degree than the other material elements forming upper 30. Thus, each tensile strand element of lateral group 50 and medial group 64 may form structural components supplementing upper 30 that resist stretching in specific directions or reinforce locations where forces are concentrated. Furthermore, when incorporated into a fastening system, such as lacing system 36, lateral group 50 and medial group 64 may help to secure upper 30 to a wearer's foot, particularly in midfoot region 12. In particular, the various tensile strands elements of lateral group 50 and medial group 64 that may extend between lacing region 38 and sole structure 20, interacting with lace 36 at lace apertures or strand loops 52 and strand loops 66, may radiate outward from strand loops 52 and strand loops 66 to resist stretch primarily in the medial-lateral direction (i.e., in a direction extending around upper 30) due to tension in lace 36.

Further Configurations

The above discussion has focused on the configuration and manufacturing techniques according to one of many embodiments described herein. It will be understood that tensile strand elements as disclosed herein may be configured in a variety of ways, and still fall within the spirit and scope of the present disclosure. For example, an article of footwear may include more or fewer tensile strand elements than is disclosed herein. In addition, alternative methods of manufacture may be used to create tensile strand elements, such as those disclosed herein. In at least one alternative configuration, for example, tensile strand elements may be embroidered directly onto a shoe upper for incorporation into an article of footwear. In yet another embodiment, tensile strand elements may be embroidered according to the techniques depicted and described with respect to FIGS. 5A-5F, and then an alternative portion 124 (shown in FIG. 5F) may be cut away from base layer 80 to reveal loops 45. Those skilled in the art will readily appreciate the variations that may be made to embodiments described herein, including the even further alternative embodiments discussed below.

Figure 9:
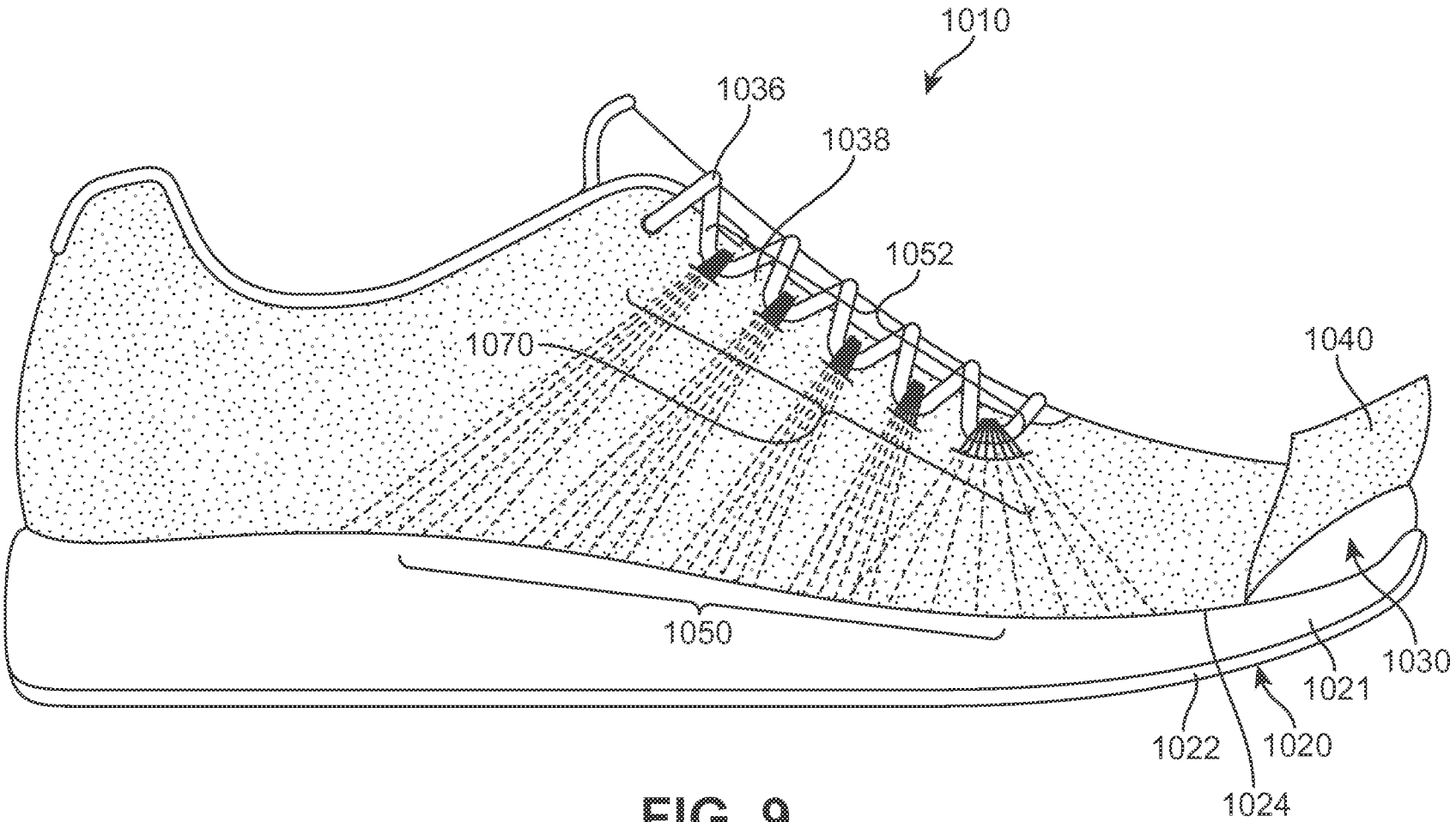
FIG. 9 is a lateral side elevational view of another configuration of an article of footwear.

FIG. 9 depicts a lateral side elevational view of an article of footwear 1010 according to another embodiment described herein. The embodiment of article 1010 is similar to the embodiment depicted and discussed in the foregoing FIGS. 1-4 and 7-8B in that footwear 1010 includes an upper 1030 attached to a sole 1020. As depicted in FIG. 9, footwear 1010 may also include a midsole 1021 and outsole 1022. Midsole 1021 may be attached to upper 1030 at lasting margin 1024, but those skilled in the art will recognize that footwear 1010 may be constructed without a midsole 1021 or may be constructed with additional layers between upper 1030 and sole 1021. Upper 1030 may also include fastening region 1038 and a fastening system, for example lace 1036.

According to the embodiment depicted in FIG. 9, footwear 1010 may also include provisions to add support and stability to upper 1030. Similar to the foregoing embodiment, footwear 1010 may include a plurality of tensile strand elements that engage with lace 1036 to help tighten upper 1030 around a wearer's foot. In particular, footwear 1010 may include a plurality of tensile strand elements, collectively tensile strand element group 1050 (represented by phantom lines in FIG. 9). Footwear 1010 may also include a similar set of tensile strand elements on a medial side (not shown). Tensile strand element group 1050 may be configured similar to lateral group 50, set forth above. Further, tensile strand element group may constructed of similar materials as discussed above in relation to the previous embodiment. In addition, tensile strand group 1050 may be manufactured and attached in a similar manner as discussed in relation to FIGS. 5A-7, above.

According to aspects described herein, footwear 1010 may also include one or more additional layers to enhance the aesthetics, durability or other properties of footwear 1010. In at least one configuration, footwear 1010 may include a cover layer 1040 over upper 1030, and tensile strand element group 1050 may be positioned under cover layer 1040. As may be seen in FIG. 9, cover layer 1040 may further provide a plurality of apertures, collectively apertures 1070, where loop portions 1052 of tensile strand element group 1050 may protrude through to engage with lace 1036. By providing cover layer 1040 with apertures 1070, loop portions 1052 may be efficiently exposed during manufacture of footwear 1010.

Cover layer 1040 may be constructed from a variety of materials, such as those materials set forth above with respect to article 10. In addition, cover layer 1040 may be constructed from an opaque material such that tensile strand element group 1050 is not visible under cover layer 1040, or a semi-transparent material such that tensile strand element group 1050 is visible under cover layer 1040. In at least one embodiment, depicted in FIG. 9, cover layer 1040 may be comprised of a mesh material such that tensile strand element group 1050 may be slightly visible beneath cover layer 1040. Cover layer 1040 may be applied to article 1010 after tensile strand element group 1050 (as well as after a medial tensile strand element group is attached, not shown) is positioned on article 1010. As with the embodiment set forth above in FIGS. 1-4 and 7-8B, a lower end of each of tensile strand element group 1050 may be rigidly attached under upper 1030 as discussed in relation to FIG. 7, above. In some cases, cover layer 1040 may be used to bond tensile strand element group 1050 to an under side of upper 1030 (not shown). Furthermore, according to aspects described herein, tensile strand element group 1050 may be movable between upper 1030 and cover layer 1040, as discussed above, such that engagement by a fastening system at loops 1052 allows the tensile strands of tensile strand element group 1050 to pull against the rigid attachment at lasting margin 1024 and to tighten, pulling upper 1030 closer and more snugly to a wearer's foot and providing support to a wearer's foot.

Figure 10:
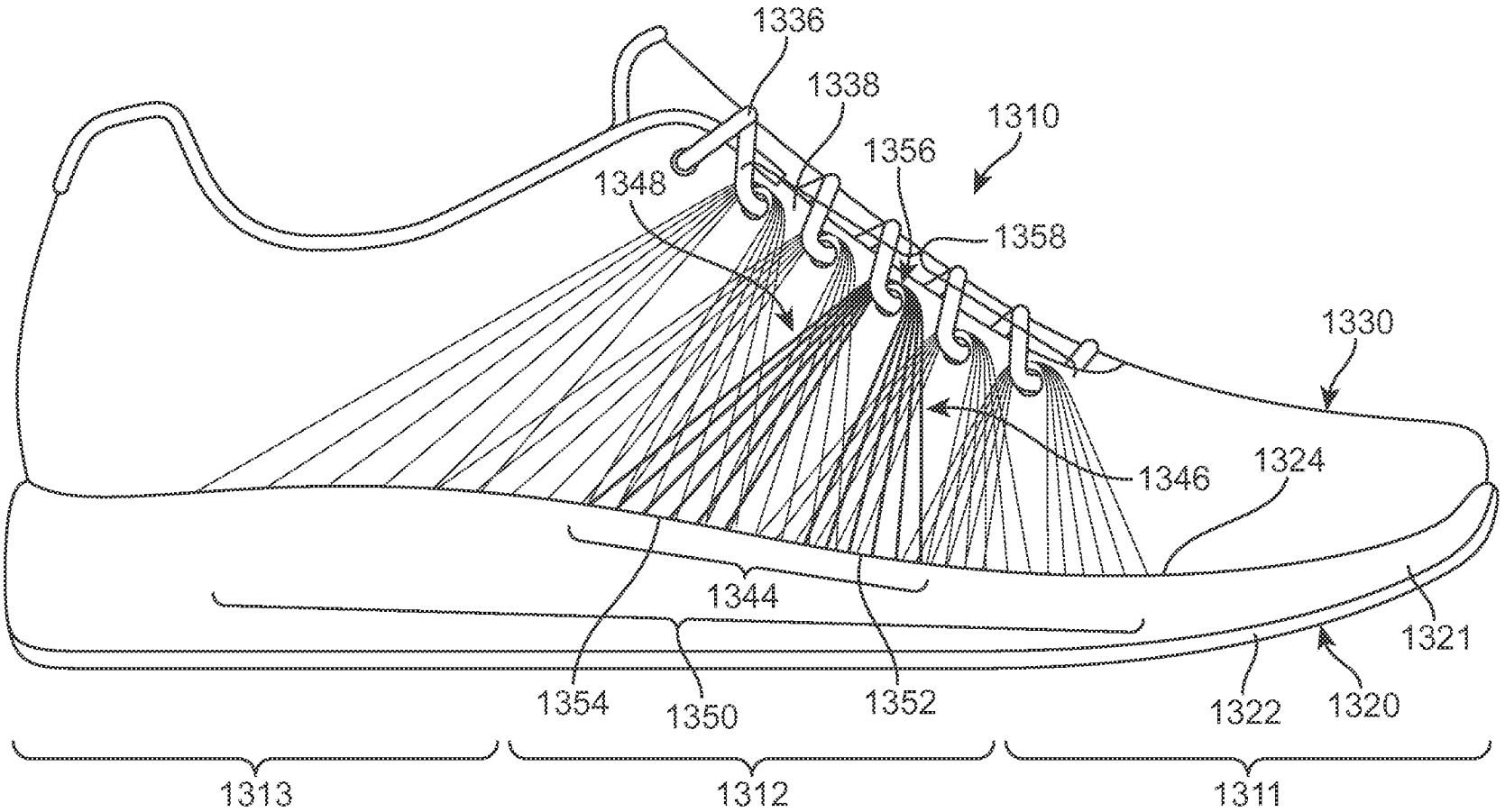
FIG. 10 is a lateral side elevational view of a further configuration of an article of footwear.

FIG. 10 depicts a lateral side elevational view of an article of footwear 1310 according to another embodiment described herein. The embodiment of footwear 1310 is also similar to the embodiments depicted and discussed in the foregoing FIGS. 1-4 and 7-9 in that footwear 1310 includes an upper 1330 attached to a sole 1320. Upper 1330 may also include fastening region 1338 and a fastening system, for example lace 1336. In at least one embodiment, upper 1330 may include eyelets 1339 through which lace 1336 is threaded. As depicted in FIG. 10, sole 1320 may include a midsole 1321 and outsole 1322. Midsole 1321 may be attached to upper 1330 at a lasting margin 1324. Like previous embodiments, those skilled in the art will recognize that footwear 1310 may have a variety of configurations and still fall within the spirit and scope of the disclosed embodiment.

According to the embodiment depicted in FIG. 10, footwear 1310 may also include provisions to add support and stability to upper 1330. Similar to the foregoing embodiment, footwear 1310 may include a plurality of tensile strand elements that engage with lace 1336 to help tighten upper 1330 around a wearer's foot. In particular, footwear 1310 may include tensile strand element group 1350. For simplicity, only one tensile strand element, lateral strand element 1344, is labeled and discussed, however, embodiments may include a plurality of tensile strand elements similar to the embodiments depicted in FIGS. 1-4 and 7-9, and as depicted by tensile strand element group 1350. Footwear 1310 may also include a similar set of tensile strand elements on a medial side (not shown).

According to aspects described herein, each tensile strand element of tensile strand element group 1350 may be attached to upper 1330 to spread tension along lasting margin 1324, creating stability across a midfoot region 1312 of footwear 1310. In particular, referring to lateral strand element 1344, a first portion 1346 may be attached to underside of upper 1330 at a first attachment point (not shown) near first area 1352. Lateral strand element 1344 may then form a loop 1356 to engage with a lace 1336 proximate fastening region 1338. A second portion 1348 of lateral strand element 1344 may then be attached to underside of upper 1330 at a second attachment point (not shown) near second area 1354. As depicted, first area 1352 may be closer to a toe region 1311 along a longitudinal direction running from a heel region 1313 to toe region 1311. In addition, second area 1354 may be closer to heel region 1313 along the longitudinal direction. As depicted in FIG. 10, the remaining tensile strand elements of tensile strand element group 1350 may be configured in a similar manner and attached along lasting margin 1324. By spreading out the attachment points of the ends of each tensile strand in tensile strand element group 1350, as lace 1336 engages with loops 1358, tension is distributed across the midfoot region 1312 of upper 1330 to pull upper 1330 snugly against a wearer's foot.

The tensile strand elements of footwear 1310 may be manufactured and attached in a similar manner as discussed in relation to FIGS. 5A-7, above. That is, lateral strand element 1344, as well as the entire tensile strand element group 1350 may be manufactured in a similar manner as discussed in relation to FIGS. 5A-5G, and may be constructed of similar materials as discussed above in relation to the previous embodiments. Further, tensile strand element group 1350 may be permanently attached to an underside of upper 1130 (not shown) as previously discussed in FIG. 7. It will also be understood that the embodiment depicted in FIG. 10 may be altered in a variety of ways, such as by adding a cover layer or varying the number and position of tensile strands, and still fall within the scope of the present disclosure.

Figure 11:
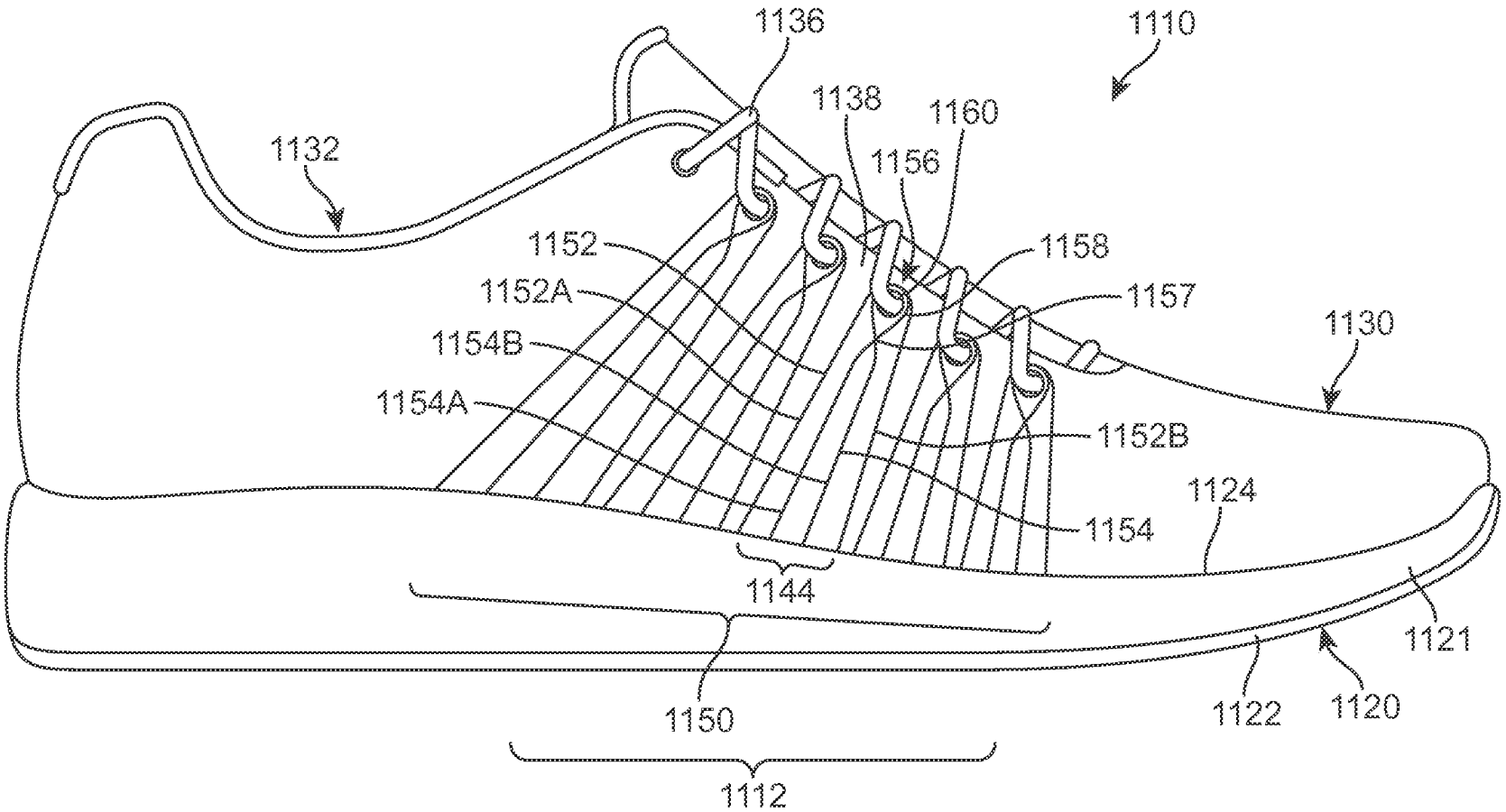
FIG. 11 is a lateral side elevational view of yet another configuration of an article of footwear.
Figure 12:
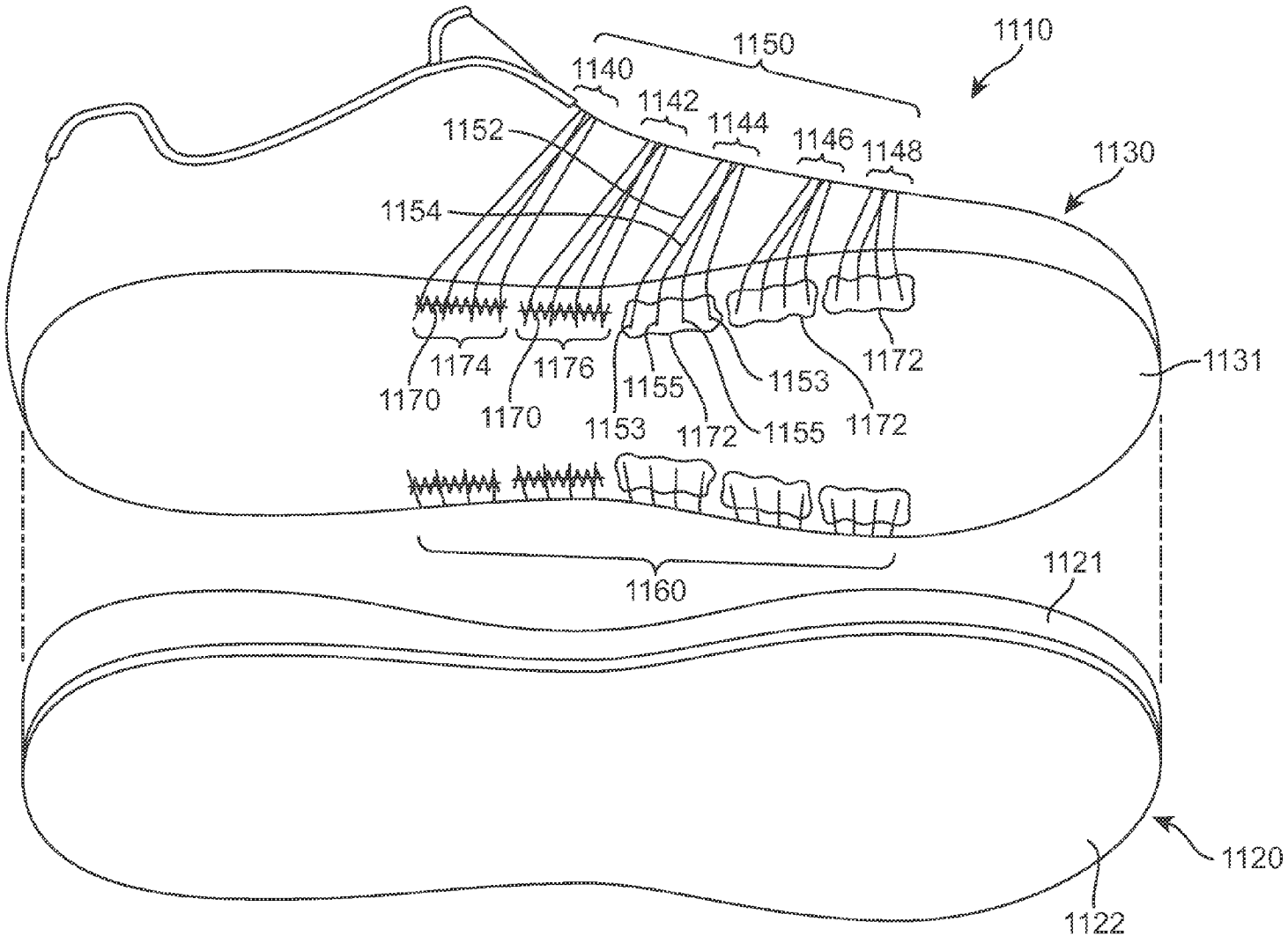
FIG. 12 is an exploded bottom perspective view of portions of the article of footwear depicted in FIG. 11.

FIGS. 11 and 12 depict a lateral side elevational view and an exploded bottom perspective view, respectively, of an article of footwear 1110 according to another embodiment described herein. The embodiment of footwear 1110 is similar to the embodiments depicted and discussed in the foregoing FIGS. 1-4 and 7-10 in that footwear 1110 also includes an upper 1130 attached to a sole 1120. As depicted in FIG. 11, footwear 1110 may also include a midsole 1121 and an outsole 1122. Midsole 1121 may be attached to upper 1130 at lasting margin 1124, but those skilled in the art will recognize that footwear 1110 may also be constructed without a midsole 1121 or may be constructed with additional layers between upper 1130 and sole 1121. Upper 1130 may also include fastening region 1138 and a fastening system, for example lace 1136.

According to the configuration depicted in FIG. 11, footwear 1110 may also include provisions to add support and stability to upper 1130. Similar to the foregoing embodiments, footwear 1110 may include a plurality of tensile strand elements that engage with lace 1136 to help tighten upper 1130 around a wearer's foot. In particular, footwear 1110 may include tensile strand element group 1150 spaced along a midfoot region 1112 of footwear 1110. Footwear 1110 may also include a similar set of tensile strand elements on a medial side (not shown).

According to the configuration depicted in FIG. 11, the tensile strand elements of tensile strand element group 1150 may each be constructed of a plurality of individual strands. In at least one embodiment, each tensile strand element in tensile strand element group 1150 may consist of two tensile strands looped at or near fastening region 1138. For simplicity, only one tensile strand element, lateral strand element 1144, is labeled and discussed, however, embodiments may include a plurality of tensile strand elements, such as those depicted by tensile strand element group 1150 in FIG. 11.

Referring to FIGS. 11 and 12, lateral strand element 1144 may be constructed from two individual tensile strands, tensile strand 1152 and tensile strand 1154. Each of tensile strand 1152 and tensile strand 1154 may be permanently attached on an underside 1131 of upper 1130 (see FIG. 12) such that a free portion of the lateral strand element 1144 is visible on footwear 1110 from the lasting margin 1124 up to the fastening region 1138 (see FIG. 11). Referring to FIG. 11, lateral strand element 1144 may consist of tensile strand 1152, which includes a heel-side portion 1152A and a toe-side portion 11528 with a loop 1156 between heel-side portion 1152A and toe-side portion 1152B in fastening region 1138. Lateral strand element 1144 may also include tensile strand 1154, which includes a heel-side portion 1154A and a toe-side portion 11548 with a loop 1158 between heel-side portion 1154A and toe-side portion 1154B in fastening region 1138. Further, loop 1156 and loop 1158 may be situated such that a lace 1136 may be threaded through eyelet 1160 as well as loop 1156 and 1158. As may be seen in FIGS. 11 and 12, in at least one configuration, heel-side portion 1154A and a toe-side portion 11548 may be twisted between the attachment at ends 1155 and loop 1158 to create twist 1157. Twist 1157 may add additional tension along lasting margin 1124 to lateral strand element 1144, allowing a wearer to pull upper 1130 more snugly against the wearer's foot, however, those skilled in the art will recognize that tensile strand 1154 may be configured without twist 1157 and still fall within the scope of the present disclosure.

The tensile strands in each of the tensile strand element group 1150 may be secured using techniques known in the art. According to some embodiments, the ends of the tensile strands in tensile strand element group 1150 may be secured to an underside 1131 of upper 1130. As depicted in FIG. 12, in at least one configuration, ends 1155 of tensile strand 1154 may be attached between ends 1153 of tensile strand 1152. FIG. 12 depicts different techniques for securing tensile strands to the underside 1131 of upper 1130. In at least one configuration, the ends of the tensile strands in tensile strand element group 1150 may be secured with an adhesive known in the art, such as a polymer adhesive. For example, ends 1153 of tensile strand 1152 and ends 1155 of tensile strand 1154 in FIG. 12 are secured with an adhesive 1172. The tensile strands may also be secured by other known methods such as by machine- or hand-stitching. For example, the ends 1174 of tensile strand element 1140 and ends 1176 of tensile strand element 1142 are secured with a row of stitching 1170. Once the tensile strand elements have been secured to upper 1130 as described above or by other known methods, upper 1130 may be attached to sole 1120 using techniques well-known in the art.

Tensile strand element group 1150 may be constructed of similar materials as discussed above in relation to the previous embodiments. For example, the tensile strands of tensile strand element group may be constructed from a variety of fibers, threads, filaments or other materials known to skilled artisans.

Figure 13:
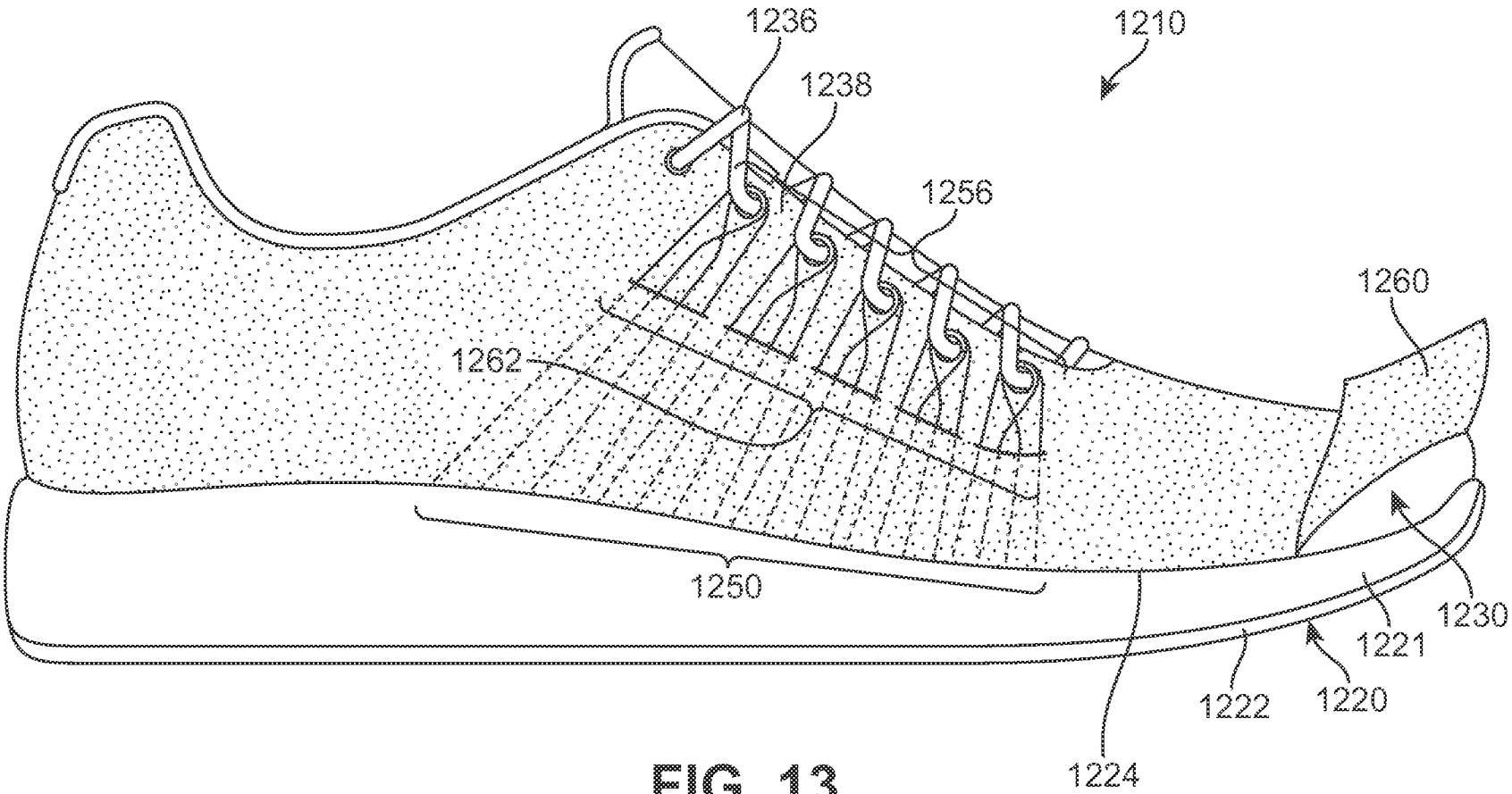
FIG. 13 is a lateral side elevational view of an article of footwear according to yet another configuration set forth herein.

FIG. 13 depicts a lateral side elevational view of an article of footwear 1210 according to yet another embodiment described herein. The embodiment of article 1210 is similar to the embodiments depicted and discussed above in relation to the foregoing FIGS. 1-4 and 7-12 in that footwear 1210 includes an upper 1230 attached to a sole 1220. As depicted in FIG. 13, footwear 1210 may also include a midsole 1221. Midsole 1221 may be attached to upper 1230 at lasting margin 1224, but those skilled in the art will recognize that footwear 1210 may be constructed without a midsole 1221 or may be constructed with additional layers between upper 1230 and sole 1221. Upper 1230 may also include fastening region 1238 and a fastening system, for example lace 1236.

According to the embodiment depicted in FIG. 13, footwear 1210 may also include provisions to add support and stability to upper 1230. In particular, footwear 1210 may include a plurality of tensile strand elements that engage with lace 1236 to help tighten upper 1230 around a wearer's foot. As depicted in FIG. 13, footwear 1210 may include tensile strand element group 1250 (represented by partial phantom lines in FIG. 13). In at least one embodiment tensile strand element group 1250 may be configured and constructed similar to tensile strand element group 1150 of FIGS. 11 and 12. Footwear 1210 may also include a similar set of tensile strand elements on a medial side (not shown). Tensile strand element group 1250 may be constructed of similar materials as discussed above in relation to the previous embodiment. In addition, tensile strand group 1250 may be manufactured and attached in a similar manner as discussed in relation to FIG. 12, above.

According to aspects described herein, footwear 1210 may also include one or more additional layers to enhance the aesthetics, durability or other properties of footwear 1210. In at least one configuration, footwear 1210 may include a cover layer 1260 over upper 1230. Furthermore, tensile strand element group 1250 may be positioned under cover layer 1260. As may be seen in FIG. 13, cover layer 1260 may provide a plurality of apertures, collectively apertures 1262, where loop portions 1256 of tensile strand element group 1250 may protrude to engage with lace 1236. By providing cover layer 1260 with apertures 1262, loop portions 1256 may be efficiently exposed during manufacture of footwear 1210.

Cover layer 1260 may be constructed from a variety of materials, such as those materials set forth above with respect to footwear 10. In addition, cover layer 1260 may be constructed from an opaque material such that a bottom a bottom portion of tensile strand element group 1250 is hidden underneath cover layer 1260, or it may be constructed from a semi-transparent material such that tensile strand element group 1250 is visible underneath cover layer 1260. In at least one embodiment, cover layer 1260 may be comprised of a mesh material such that tensile strand element group 1250 may be slightly visible beneath cover layer 1260. Cover layer 1260 may be applied to article 1210 after tensile strand element group 1250 (as well as after a medial tensile strand element group is attached, not shown) is positioned on article 1210. As with the embodiment set forth above in FIGS. 11 and 12, a lower end of each of tensile strand element group 1250 may be rigidly attached under upper 1260 as discussed in relation to FIG. 12, above. In some cases, cover layer 1260 may be used to bond tensile strand element group 1250 to an under side of upper 1230 (not shown). Furthermore, according to aspects described herein, tensile strand element group 1250 may be movable between upper 1230 and cover layer 1260, as discussed above, such that engagement by a fastening system at loops 1256 allows the tensile strands of tensile strand element group 1250 to pull against the rigid attachment at lasting margin 1224 and to tighten, pulling upper 1230 closer and more snugly to a wearer's foot and providing support to a wearer's foot.

Figure 14:
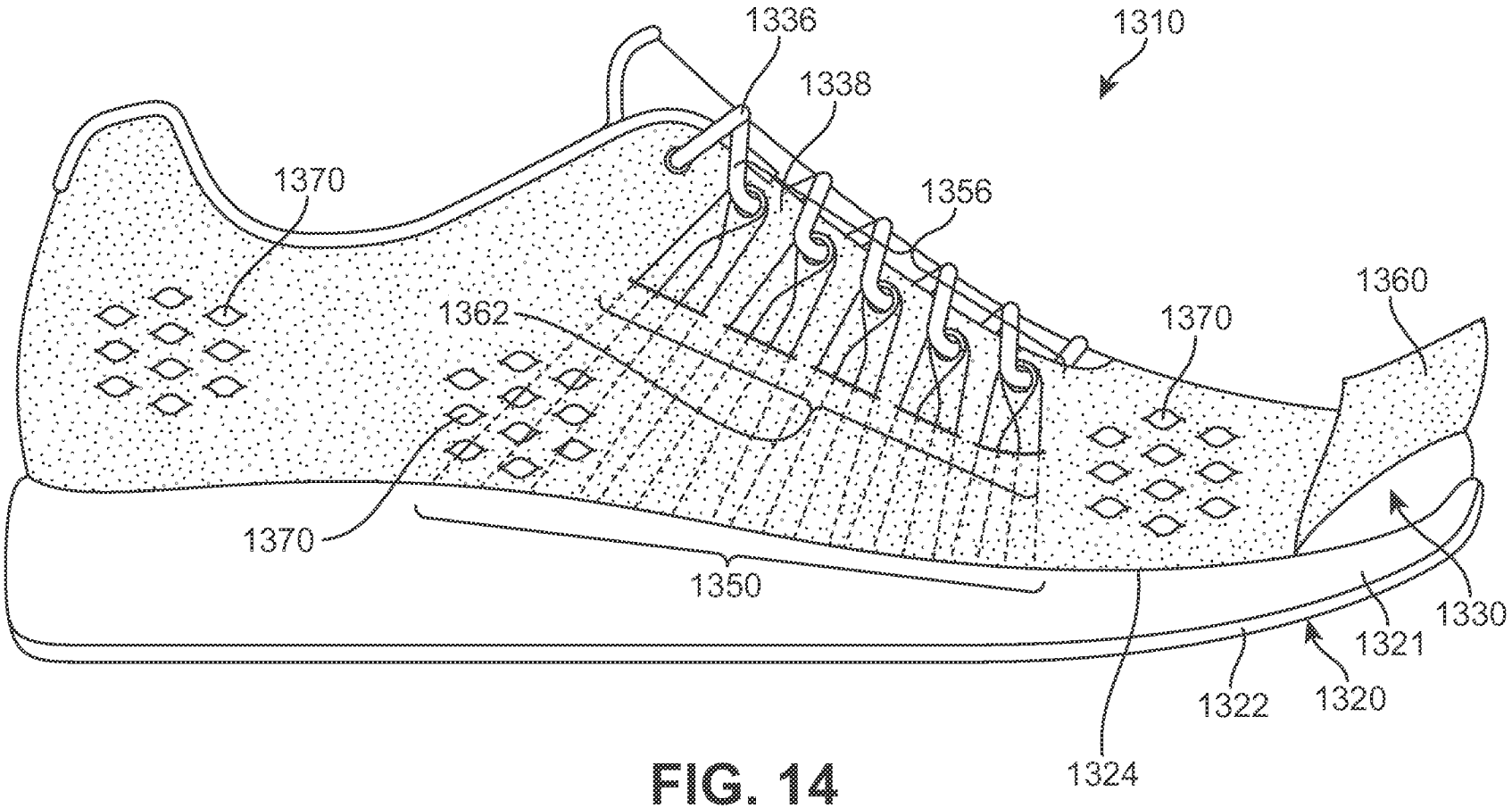
FIG. 14 is a lateral side elevational view of an article of footwear according to yet another configuration set forth herein.

FIG. 14 depicts a lateral side elevational view of an article of footwear 1310 according to yet another embodiment described herein. The embodiment of article 1310 is also similar to the foregoing embodiments in that footwear 1310 includes an upper 1330 attached to a sole 1320. As depicted in FIG. 14, footwear 1310 may also include a midsole 1321. Midsole 1321 may be attached to upper 1330 at lasting margin 1324, but those skilled in the art will recognize that footwear 1310 may also be constructed without a midsole 1321 or may be constructed with additional layers between upper 1330 and sole 1321. Upper 1330 may also include fastening region 1338 and a fastening system, for example lace 1336.

According to the embodiment depicted in FIG. 14, footwear 1310 may also include provisions to add support and stability to upper 1330. In particular, footwear 1310 may include a plurality of tensile strand elements that engage with lace 1336 to help tighten upper 1330 around a wearer's foot. As depicted in FIG. 14, footwear 1310 may include tensile strand elements similar to those discussed above and depicted in FIGS. 11-13, collectively tensile strand element group 1350 (represented by partial phantom lines in FIG. 14). Footwear 1310 may also include a similar set of tensile strand elements on a medial side (not shown). Tensile strand element group 1350 may be constructed of similar materials as discussed above in relation to the previous embodiments. In addition, tensile strand group 1350 may be manufactured and attached in a similar manner as discussed in relation to FIG. 12, above.

According to aspects described herein, footwear 1310 may also include one or more additional layers to enhance the aesthetics, durability or other properties of footwear 1310. In at least one configuration, footwear 1310 may include a cover layer 1360 over upper 1330. Furthermore, tensile strand element group 1350 may be positioned under cover layer 1360. As may be seen in FIG. 14, cover layer 1360 may provide a plurality of apertures, collectively apertures 1362, where loop portions 1356 of tensile strand element group 1350 may protrude through to engage with lace 1336. Similar to previously discussed embodiments, by providing cover layer 1360 with apertures 1362, loop portions 1356 may be efficiently exposed during manufacture of footwear 1310.

Cover layer 1360 may be constructed from a variety of materials, such as those materials set forth above with respect to footwear 10. In some cases, cover layer 1360 may be constructed from a semi-transparent material such that tensile strand element group 1350 is visible underneath cover layer 1360. In at least one configuration, as depicted in FIG. 14, cover layer 1360 may be comprised of a semi-transparent, knit material. In particular, cover layer 1360 may be constructed from a warp-knitted mesh material made from synthetic fibers. According to the embodiment depicted in FIG. 14, the warp-knitted mesh material may include a plurality of holes 1370 in a patterned design. In other embodiments, the warp-knitted mesh material may be configured with holes in an alternative patterned design (not shown). In still other embodiments, the warp-knitted mesh material may be configured without holes altogether. As would be understood by those skilled in the art, a warp-knitted fabric has inherent elastic properties that may allow for stretch around a wearer's foot.

Cover layer 1360 may be applied to article 1310 after tensile strand element group 1350 (as well as after a medial tensile strand element group is attached, not shown) is positioned on article 1310. As with the embodiment set forth above in FIGS. 11-13, a lower end of each of tensile strand element group 1350 may be rigidly attached under upper 1360 as discussed in relation to FIG. 12, above. In some cases, cover layer 1360 may be used to bond tensile strand element group 1350 to an under side of upper 1330 (not shown). Furthermore, according to aspects described herein, tensile strand element group 1350 may be movable between upper 1330 and cover layer 1360, as discussed above, such that engagement by a fastening system at loops 1356 allows the tensile strands of tensile strand element group 1350 to pull against the rigid attachment at lasting margin 1324 and to tighten, pulling upper 1330 closer and more snugly to a wearer's foot and providing support to a wearer's foot.

While various embodiments of the present disclosure have been described, the description is intended to be exemplary, rather than limiting and it will be apparent to those of ordinary skill in the art that many more embodiments and implementations are possible that are within the scope of the present disclosure. For example, the strand elements set forth in any of the above embodiments may be varied in the number of individual strands incorporated into the strand element and by the amount of spacing between each of the individual strands in a strand element along the lasting margin. In addition, the deflection angle of the strand elements from the fastening region down to the lasting margin may be varied in any of the above embodiments to vary the tension applied across the lasting margin. Even further, the attachment points of the strands along the lasting margin may be varied, or one or many of the attachment points may be at different locations on the footwear, such as in the fastening region.

In at least one alternate configuration, for example, one or more strand elements may be attached at a first point along the lasting margin and attached at a second point in the fastening region. More specifically, one or more strand elements may be rigidly attached near the sole, extend upward from the sole, and then may be secured in a loop to engage with a fastening system, such as a shoelace, or any other means contemplated by a skilled artisan. In some cases, the loop may be formed around an eyelet. Further, after forming a loop, the second end of the strand element may be attached to the strand element itself or to another area in the fastening region, forming an approximate p-shape along the shoe upper.

Accordingly, it will be readily understood that the full breadth of the present disclosure is not to be restricted except in light of the attached claims and their equivalents. Also, various modifications and changes may be made within the scope of the attached claims and still fall within the spirit and scope of the concepts described herein.

What is claimed is:

1. An article of footwear comprising:

an upper having a fastening region;

a sole attached to the upper and spaced from the fastening region;

a fastening system; and a tensile strand element having a tensile strand with a first attachment point, a second attachment point, and an unsecured portion located between the first attachment point and the second attachment point, wherein:

the unsecured portion includes an innermost portion and an outermost portion positioned over the innermost portion, the innermost portion being closer to the upper than the outermost portion;

the first attachment point and the second attachment point are adjacent to the sole; and the unsecured portion includes a looped portion configured to receive an element of the fastening system.

2. The article of footwear according to claim 1, wherein the tensile strand element is secured between the sole and the upper at the first attachment point and at the second attachment point.

3. The article of footwear according to claim 1, wherein the fastening system comprises laces.

4. The article of footwear according to claim 1, wherein the tensile strand element comprises a plurality of tensile strands.

5. The article of footwear according to claim 4, wherein the tensile strand element comprises 6 tensile strands.

6. The article of footwear according to claim 5, wherein the 6 tensile strands are formed from one tensile strand that is secured at 12 attachment points to create 6 unsecured portions.

7. The article of footwear according to claim 1, further comprising a cover layer positioned over the upper and the tensile strand element.

8. The article of footwear according to claim 7, wherein the cover layer comprises an aperture, and wherein the looped portion of the tensile strand element protrudes through the aperture towards the exterior surface of the upper.

9. The article of footwear according to claim 4, wherein:

each of the plurality of tensile strands includes two attachment points forming a plurality of attachment points and an unsecured portion located between the two attachment points forming a plurality of looped portions;

the plurality of looped portions are co-located and configured to receive an element of the fastening system together; and each of the plurality of tensile strands extends from the plurality of looped portions to the plurality of attachment points, the plurality of attachment points being spaced apart and adjacent to the sole, the plurality of tensile strands together deflecting in a tent-like shape from the fastening region to the sole.

10. The article of footwear according to claim 1, wherein the tensile strand element is positioned on a lateral side of the upper.

11. The article of footwear according to claim 1, wherein the tensile strand element is positioned on a medial side of the upper.

12. An article of footwear comprising:

an upper having a fastening region that includes a lace;

a sole attached to the upper and spaced from the fastening region; and a tensile strand element including a plurality of tensile strands, each of the plurality of tensile strands having two attachment points and an unsecured portion located between the two attachment points, each unsecured portion having a looped portion, wherein each looped portion is co-located and is configured to receive an element of the fastening system.

13. The article of footwear according to claim 12, wherein each of the plurality of tensile strands is secured between the sole and the upper at the respective two attachment points.

14. The article of footwear according to claim 12, further comprising a plurality of tensile strand elements.

15. The article of footwear according to claim 12, wherein the tensile strand element comprises 6 tensile strands.

16. The article of footwear according to claim 15, wherein the 6 tensile strands are formed from one tensile strand that is secured at 12 attachment points to create 6 unsecured portions.

17. The article of footwear according to claim 12, wherein:

for each of the plurality of tensile strands, the plurality of looped portions are co-located and configured to receive an element of the fastening system together; and the plurality of tensile strands extend from the plurality of looped portions to the respective two attachment points, the respective two attachment points for each tensile strand being spaced apart and adjacent to the sole, the plurality of tensile strands together deflecting in a tent-like shape from the looped portions to the two attachment points.

18. The article of footwear according to claim 12, further comprising a cover layer positioned over the upper and the tensile strand element.

19. The article of footwear according to claim 18, wherein the cover layer comprises an aperture, and wherein the looped portions of the tensile strand element protrude through the aperture towards an outer surface of the article of footwear.

20. The article of footwear according to claim 12, wherein the tensile strand element is positioned on a lateral side of the upper.

21. The article of footwear according to claim 12, wherein the tensile strand element is positioned on a medial side of the upper.

22. The article of footwear according to claim 12, wherein the plurality of tensile strands comprises:

a first tensile strand with a first attachment point, a second attachment point, and a first unsecured portion located between the first attachment point and the second attachment point, the first unsecured portion including a first looped portion, a second tensile strand with a third attachment point, a fourth attachment point, and a second unsecured portion located between the third attachment point and the fourth attachment point, the second unsecured portion including a second looped portion, and wherein the first attachment point and the second attachment point are located proximate the sole, and wherein the first attachment point is closer to a heel end of the article of footwear and the second attachment point is closer to a toe end of the article of footwear; and wherein the third attachment point and the fourth attachment point are located proximate the sole between the first attachment point and the second attachment point, and wherein the third attachment point is closer to a heel end of the article of footwear and the fourth attachment point is closer to a toe end of the article of footwear.

23. The article of footwear according to claim 12, wherein the second tensile strand includes a first portion located between the third attachment point and the second looped portion and a second portion located between the fourth attachment point and the second looped portion, and wherein the first portion crosses the second portion.

24. The article of footwear according to claim 12, wherein an axis running through the first looped portion and the second looped portion is parallel to the upper.

* * * * *